US011498746B2

(12) United States Patent
Morine et al.

(10) Patent No.: US 11,498,746 B2
(45) Date of Patent: Nov. 15, 2022

(54) INSULATED SHIPPING CONTAINER

(71) Applicant: Otter Products, LLC, Fort Collins, CO (US)

(72) Inventors: Alan V. Morine, Fort Collins, CO (US); Jonathan H. Guerdrum, Fort Collins, CO (US); Matthew A. Ryan, Fort Collins, CO (US); Joshua R. Cornish, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 167 days.

(21) Appl. No.: 17/152,176

(22) Filed: Jan. 19, 2021

(65) Prior Publication Data

US 2021/0139225 A1 May 13, 2021

Related U.S. Application Data

(63) Continuation of application No. 16/904,792, filed on Jun. 18, 2020, now Pat. No. 11,377,290.
(Continued)

(51) Int. Cl.
*B65D 81/38* (2006.01)
*F25D 3/08* (2006.01)
(Continued)

(52) U.S. Cl.
CPC ..... *B65D 81/3825* (2013.01); *B65D 21/0233* (2013.01); *B65D 25/04* (2013.01);
(Continued)

(58) Field of Classification Search
CPC ..... B65D 81/3825; B65D 77/26
See application file for complete search history.

(56) References Cited

U.S. PATENT DOCUMENTS 1,468,563 A 9/1923 Girard
2,496,296 A 2/1950 Frederick
(Continued)

FOREIGN PATENT DOCUMENTS

EP 3061704 A1 8/2016
WO 2004029526 A1 4/2004
(Continued)

OTHER PUBLICATIONS

U.S. Appl. No. 16/566,191, filed Sep. 10, 2019, Jonathan H. Guerdrum.
(Continued)

*Primary Examiner* — Mollie Impink

(57) ABSTRACT

An insulated container for storing or shipping bottles includes a body and a lid. The body has a shell and an insert portion formed from an insulating material. The lid also has a shell and an insert portion formed from the insulating which meets the insert portion of the body to form cavities. The cavities include a temperature control pack cavity and four or more separate bottle storage cavities distributed around the temperature control pack cavity. Each of the bottle storage cavities is configured for receiving a bottle from among three or more different bottle types. Each of the bottle types has a different shape and/or size than each of the other bottle types. Each of the bottle storage cavities includes at least three bottle stop features on one or more internal surfaces. Each bottle stop feature is associated with a different one of the three or more bottle types.

19 Claims, 21 Drawing Sheets

Related U.S. Application Data

(60) Provisional application No. 62/874,016, filed on Jul. 15, 2019.

(51) Int. Cl.

| | |
|---|---|
| ***B65D 25/04*** | (2006.01) |
| ***B65D 81/05*** | (2006.01) |
| ***F25D 3/00*** | (2006.01) |
| ***B65D 21/02*** | (2006.01) |
| ***B65D 55/02*** | (2006.01) |
| ***B65D 25/28*** | (2006.01) |
| ***B65D 25/10*** | (2006.01) |
| ***B65D 81/113*** | (2006.01) |

(52) U.S. Cl.

CPC ..... *B65D 25/10* (2013.01); *B65D 25/2897* (2013.01); *B65D 55/02* (2013.01); *B65D 81/05* (2013.01); *B65D 81/113* (2013.01); *B65D 81/3818* (2013.01); *F25D 3/00* (2013.01); *F25D 3/08* (2013.01); *F25D 2303/0841* (2013.01); *F25D 2303/0843* (2013.01); *F25D 2303/08222* (2013.01); *F25D 2331/803* (2013.01); *F25D 2500/02* (2013.01)

(56) References Cited

U.S. PATENT DOCUMENTS

| | | | |
|---|---|---|---|
| 2,610,759 | A | 9/1952 | Slade |
| 2,627,993 | A | 2/1953 | Hafner |
| 2,632,311 | A | 3/1953 | Sullivan |
| 2,635,779 | A | 4/1953 | Pfeiffer |
| 3,200,983 | A | 8/1965 | Walter |
| 3,347,060 | A | 10/1967 | Barkan |
| 3,395,550 | A | 8/1968 | Dungan |
| 3,398,850 | A | 8/1968 | John |
| 3,401,535 | A | 9/1968 | Palmer |
| 3,436,932 | A | 4/1969 | Paquin |
| 3,605,431 | A | 9/1971 | Carson |
| 3,658,035 | A | 4/1972 | Harris |
| 3,675,808 | A | 7/1972 | Brink |
| 3,850,398 | A | 11/1974 | Kantor |
| 3,868,829 | A | 3/1975 | Mann et al. |
| 3,939,986 | A | 2/1976 | Pierro |
| 3,961,708 | A * | 6/1976 | Von Dohlen ..... B65D 81/027 229/120.07 |
| 4,024,731 | A | 5/1977 | Branscum |
| 4,143,695 | A | 3/1979 | Hoehn |
| 4,172,365 | A | 10/1979 | McClintock |
| 4,213,310 | A | 7/1980 | Buss |
| 4,235,346 | A | 11/1980 | Liggett |
| 4,319,629 | A | 3/1982 | Hotta |
| 4,336,883 | A | 6/1982 | Krug et al. |
| 4,344,301 | A | 8/1982 | Taylor |
| 4,372,444 | A | 2/1983 | Grand et al. |
| 4,441,336 | A | 4/1984 | Cannon |
| D275,822 | S | 10/1984 | Gatland et al. |
| 4,499,997 | A | 2/1985 | Swingley, Jr. |
| 4,499,998 | A | 2/1985 | Carlson |
| 4,509,587 | A | 4/1985 | Clark et al. |
| 4,515,421 | A | 5/1985 | Steffes |
| 4,529,092 | A | 7/1985 | Swingley, Jr. |
| 4,560,128 | A | 12/1985 | Willeby et al. |
| 4,577,773 | A | 3/1986 | Bitel |
| 4,606,461 | A | 8/1986 | Bolton |
| D285,413 | S | 9/1986 | Carlson |
| 4,746,008 | A | 5/1988 | Heverly et al. |
| 4,759,467 | A | 7/1988 | Byrne |
| RE32,740 | E | 8/1988 | Steffes |
| 4,819,793 | A | 4/1989 | Willard et al. |
| 4,841,661 | A | 6/1989 | Moore |
| 4,872,589 | A | 10/1989 | Englehart et al. |
| 4,923,077 | A | 5/1990 | Iperen et al. |
| 4,964,528 | A | 10/1990 | Wagoner |
| 4,988,216 | A | 1/1991 | Lyman |
| 5,050,766 | A | 9/1991 | Groh |
| 5,052,185 | A | 10/1991 | Spahr |
| D325,323 | S | 4/1992 | Kahl |
| 5,103,884 | A | 4/1992 | Roman |
| 5,103,998 | A | 4/1992 | Caro et al. |
| D327,427 | S | 6/1992 | McCooey |
| D328,389 | S | 8/1992 | Pardo |
| D330,488 | S | 10/1992 | Daniels |
| 5,181,612 | A | 1/1993 | Liu |
| 5,215,248 | A | 6/1993 | Moser |
| 5,285,656 | A | 2/1994 | Peters |
| 5,299,688 | A | 4/1994 | McKay et al. |
| 5,329,787 | A | 7/1994 | Friday |
| 5,353,946 | A | 10/1994 | Behrend |
| D353,082 | S | 12/1994 | Keven |
| D354,419 | S | 1/1995 | Kahl et al. |
| 5,390,797 | A | 2/1995 | Smalley et al. |
| 5,403,095 | A | 4/1995 | Melk |
| 5,405,012 | A | 4/1995 | Shindler et al. |
| 5,427,446 | A | 6/1995 | Glomski |
| 5,447,041 | A | 9/1995 | Piechota |
| 5,493,874 | A | 2/1996 | Landgrebe |
| 5,509,279 | A | 4/1996 | Brown et al. |
| 5,522,239 | A | 6/1996 | Schwartz et al. |
| 5,562,228 | A | 10/1996 | Ericson |
| 5,605,056 | A | 2/1997 | Brown et al. |
| 5,622,276 | A | 4/1997 | Simmons |
| 5,669,233 | A | 9/1997 | Cook et al. |
| D387,249 | S | 12/1997 | Mogil |
| D391,121 | S | 2/1998 | Melk |
| 5,816,432 | A | 10/1998 | Hammen et al. |
| 5,845,515 | A | 12/1998 | Nelson |
| 5,850,915 | A | 12/1998 | Tajima |
| 5,857,778 | A | 1/1999 | Ells |
| 5,913,448 | A | 6/1999 | Mann et al. |
| D419,297 | S | 1/2000 | Richardson et al. |
| D419,767 | S | 2/2000 | Richardson et al. |
| D419,768 | S | 2/2000 | Richardson et al. |
| 6,026,978 | A | 2/2000 | Clegg et al. |
| 6,039,202 | A | 3/2000 | Olstad et al. |
| D425,761 | S | 5/2000 | Philipson et al. |
| 6,065,873 | A | 5/2000 | Fowler |
| D435,196 | S | 12/2000 | Gregor et al. |
| 6,185,860 | B1 | 2/2001 | Thibodeaux |
| 6,193,097 | B1 | 2/2001 | Perianes |
| D441,261 | S | 5/2001 | Stein |
| 6,226,844 | B1 | 5/2001 | Lerra et al. |
| 6,234,677 | B1 | 5/2001 | Mogil |
| 6,244,458 | B1 | 6/2001 | Frysinger et al. |
| D444,683 | S | 7/2001 | Corrion |
| 6,276,579 | B1 | 8/2001 | DeLoach |
| 6,295,830 | B1 | 10/2001 | Newman |
| 6,318,114 | B1 | 11/2001 | Slaughter |
| D451,765 | S | 12/2001 | Israel et al. |
| 6,325,281 | B1 | 12/2001 | Grogan |
| 6,328,179 | B1 | 12/2001 | Conrado et al. |
| 6,336,342 | B1 | 1/2002 | Zeddies |
| D455,934 | S | 4/2002 | Culp et al. |
| 6,409,066 | B1 | 6/2002 | Schneider et al. |
| D465,134 | S | 11/2002 | Joss |
| 6,474,095 | B1 | 11/2002 | Chan |
| D469,012 | S | 1/2003 | Lee |
| 6,505,479 | B2 | 1/2003 | Defelice et al. |
| D472,384 | S | 4/2003 | Richardson |
| 6,582,124 | B2 | 6/2003 | Mogil |
| 6,595,687 | B2 | 7/2003 | Godshaw et al. |
| 6,736,309 | B1 | 5/2004 | Westerman et al. |
| 6,751,963 | B2 | 6/2004 | Navedo et al. |
| 6,782,711 | B2 | 8/2004 | Abfalter |
| D502,599 | S | 3/2005 | Cabana et al. |
| 6,895,778 | B1 | 5/2005 | Ackerman |
| 6,966,450 | B2 | 11/2005 | Askew |
| D513,122 | S | 12/2005 | Greene |
| D513,123 | S | 12/2005 | Richardson et al. |
| D514,808 | S | 2/2006 | Morine et al. |
| 6,993,931 | B1 | 2/2006 | Hamilton |
| 7,004,323 | B1 | 2/2006 | Symonds |
| D516,807 | S | 3/2006 | Richardson et al. |

(56) References Cited

U.S. PATENT DOCUMENTS

D527,226 S 8/2006 Maldonado
D527,953 S 9/2006 Gal
7,140,507 B2 11/2006 Maldonado et al.
7,147,125 B1 12/2006 Slovak et al.
7,195,127 B2 3/2007 Hsu et al.
D543,030 S 5/2007 Schäfer
7,257,963 B2 8/2007 Mayer
D553,999 S 10/2007 Mason
7,296,433 B2 11/2007 Uihlein et al.
D558,599 S 1/2008 Tilman et al.
D569,902 S 5/2008 Chang et al.
7,389,608 B1 6/2008 MacKay
7,415,794 B1 8/2008 Thompson
7,422,143 B2 9/2008 Mayer
7,682,080 B2 3/2010 Mogil
D623,075 S 9/2010 Blythe
D623,947 S 9/2010 Levy
7,791,003 B2 9/2010 Lockhart et al.
7,810,350 B2 10/2010 Shelton
7,882,706 B2 2/2011 Thali et al.
7,900,816 B2 3/2011 Kastanek et al.
7,908,870 B2 3/2011 Williams et al.
D635,832 S 4/2011 Bergin
D637,044 S 5/2011 Davis
7,950,246 B1 5/2011 Mayer et al.
7,984,820 B2 7/2011 Dancyger
D643,629 S 8/2011 Sofy et al.
8,011,194 B2 9/2011 Dimmitt
8,043,004 B2 10/2011 Mogil
D649,587 S 11/2011 Nemeth et al.
8,061,159 B2 11/2011 Mogil et al.
8,061,522 B2 * 11/2011 Eskenazi ..... B65D 81/05 206/594
8,061,547 B2 11/2011 Camp, Jr.
8,065,889 B1 11/2011 Silberman
D659,014 S 5/2012 Blythe
8,209,995 B2 7/2012 Kieling et al.
8,246,190 B2 8/2012 Boiteau et al.
8,317,046 B2 11/2012 Vanderberg et al.
8,365,944 B2 2/2013 Vanderberg et al.
8,403,162 B2 3/2013 Vanderberg et al.
8,418,874 B2 4/2013 Ahlgrim et al.
8,424,699 B2 4/2013 Vanderberg et al.
8,430,265 B2 4/2013 Vanderberg et al.
8,448,813 B2 5/2013 Vanderberg et al.
8,607,581 B2 12/2013 Williams et al.
8,608,015 B2 12/2013 Wolf et al.
D697,770 S 1/2014 Khuu
8,622,235 B2 1/2014 Suchecki
D699,119 S 2/2014 Fukuda et al.
D712,720 S 9/2014 Seiders
D712,721 S 9/2014 Seiders
D712,722 S 9/2014 Seiders
D712,723 S 9/2014 Seiders
D714,125 S 9/2014 Seiders
8,844,316 B1 9/2014 Ademola et al.
8,863,546 B2 10/2014 Oberweis
8,875,964 B1 11/2014 Vanderberg
8,910,819 B2 12/2014 Seiders
8,919,082 B1 12/2014 Cataldo
8,925,752 B2 1/2015 Smith
D722,474 S 2/2015 Seiders
D722,475 S 2/2015 Seiders
D726,816 S 4/2015 Ehrlich et al.
9,022,249 B2 5/2015 Ranade
D730,649 S 6/2015 Thomas
D732,348 S 6/2015 Seiders et al.
D732,349 S 6/2015 Seiders et al.
D732,350 S 6/2015 Seiders et al.
D732,899 S 6/2015 Seiders et al.
9,108,790 B2 8/2015 Daley
9,139,352 B2 9/2015 Seiders et al.
9,182,168 B2 11/2015 Hernandez et al.
9,187,232 B2 11/2015 Seiders
9,205,962 B2 12/2015 Holderby
D748,978 S 2/2016 Glass et al.
D752,347 S 3/2016 Seiders et al.
9,290,297 B2 3/2016 Overath
9,314,143 B2 4/2016 Bensussan et al.
9,316,428 B2 4/2016 Mech
D757,534 S 5/2016 Matsuura
9,389,010 B1 7/2016 Booker
9,408,445 B2 8/2016 Mogil et al.
9,433,200 B2 9/2016 Norman
9,446,847 B2 9/2016 Richardson et al.
9,500,400 B2 11/2016 Smith
9,540,138 B2 1/2017 Dubois et al.
D778,614 S 2/2017 Ananian et al.
9,834,342 B2 4/2017 Seiders
D785,334 S 5/2017 Holt et al.
D786,559 S 5/2017 Seiders et al.
D786,560 S 5/2017 Seiders et al.
D786,561 S 5/2017 Seiders et al.
D786,562 S 5/2017 Seiders et al.
D787,187 S 5/2017 Seiders et al.
D797,454 S 9/2017 Seiders et al.
D797,455 S 9/2017 Seiders et al.
9,751,682 B2 9/2017 Mayer et al.
D798,670 S 10/2017 Seiders et al.
D799,276 S 10/2017 Seiders et al.
D799,277 S 10/2017 Seiders et al.
D799,905 S 10/2017 Seiders et al.
D801,123 S 10/2017 Seiders et al.
9,796,517 B2 10/2017 Seiders et al.
D802,373 S 11/2017 Seiders et al.
D803,041 S 11/2017 Patterson
9,809,357 B2 11/2017 Arnold et al.
D804,905 S 12/2017 Seiders et al.
D805,851 S 12/2017 Seiders et al.
9,920,977 B1 3/2018 Avila
9,981,778 B2 5/2018 Plattner
D820,646 S 6/2018 Yockey
D821,165 S 6/2018 Guerdrum et al.
D821,825 S 7/2018 Sullivan et al.
D823,064 S 7/2018 Eichinger et al.
D823,065 S 7/2018 Eichinger et al.
D823,066 S 7/2018 Eichinger et al.
10,029,842 B2 7/2018 Seiders et al.
D824,730 S 8/2018 Guerdrum et al.
10,046,900 B2 8/2018 Seiders
D828,029 S 9/2018 Seiders et al.
10,092,137 B1 10/2018 Nelson et al.
D835,470 S 12/2018 Seiders et al.
D835,471 S 12/2018 Seiders et al.
D835,472 S 12/2018 Seiders et al.
D835,946 S 12/2018 Seiders et al.
D838,983 S 1/2019 Seiders et al.
D838,984 S 1/2019 Seiders et al.
D840,150 S 2/2019 Seiders et al.
10,221,005 B2 3/2019 James
D845,717 S 4/2019 Cavenagh et al.
D850,865 S 6/2019 Smith et al.
10,351,330 B2 7/2019 Smith et al.
D856,673 S 8/2019 Stirnimann et al.
10,392,180 B1 8/2019 Travis et al.
10,443,918 B2 10/2019 Li et al.
10,676,235 B1 6/2020 Song et al.
10,676,267 B2 6/2020 Seiders et al.
D908,357 S 1/2021 Guerdrum et al.
D912,400 S 3/2021 Guerdrum et al.
2003/0038138 A1 2/2003 Komurke
2003/0106895 A1 6/2003 Kalal
2003/0136702 A1 7/2003 Redzisz et al.
2003/0141424 A1 7/2003 Thomas
2004/0143944 A1 7/2004 Huang
2004/0178208 A1 9/2004 Leba et al.
2004/0238543 A1 12/2004 Askew
2004/0262319 A1 12/2004 Fisher
2005/0006268 A1 1/2005 Futernick
2005/0133557 A1 6/2005 McKenzie et al.
2005/0263527 A1 12/2005 Maldonado et al.
2005/0263528 A1 12/2005 Maldonado et al.
2005/0279123 A1 12/2005 Maldonado et al.
2005/0279124 A1 12/2005 Maldonado

(56) References Cited

U.S. PATENT DOCUMENTS

| | | | |
|---|---|---|---|
| 2005/0279666 | A1 | 12/2005 | Deng et al. |
| 2005/0281487 | A1 | 12/2005 | Pawloski et al. |
| 2006/0065655 | A1 | 3/2006 | Taylor |
| 2006/0169658 | A1 | 8/2006 | Lim et al. |
| 2006/0180624 | A1 | 8/2006 | Sadow et al. |
| 2007/0028642 | A1 | 2/2007 | Glade et al. |
| 2007/0137958 | A1 | 6/2007 | Hamlin |
| 2007/0186579 | A1 | 8/2007 | Barker |
| 2007/0277546 | A1 | 12/2007 | Lehman |
| 2007/0278234 | A1 | 12/2007 | Mogil |
| 2008/0094853 | A1 | 4/2008 | Kim et al. |
| 2008/0121630 | A1 | 5/2008 | Simard |
| 2008/0128428 | A1 | 6/2008 | Beckerman |
| 2008/0257918 | A1 | 10/2008 | Vogel et al. |
| 2008/0260303 | A1 | 10/2008 | Lesseux et al. |
| 2008/0296194 | A1 | 12/2008 | Stahl |
| 2008/0307824 | A1 | 12/2008 | Botich |
| 2009/0052809 | A1 | 2/2009 | Sampson |
| 2009/0078709 | A1 | 3/2009 | Murrer, III |
| 2009/0159471 | A1 | 6/2009 | Koppe |
| 2009/0218342 | A1 | 9/2009 | Pickles |
| 2009/0261111 | A1 | 10/2009 | Hsu |
| 2010/0001018 | A1 | 1/2010 | Puma |
| 2010/0065466 | A1 | 3/2010 | Perkins |
| 2010/0072215 | A1 | 3/2010 | Coon |
| 2010/0287976 | A1 | 11/2010 | Roof et al. |
| 2011/0056233 | A1 | 3/2011 | Flaker et al. |
| 2011/0182532 | A1 | 7/2011 | Baltus |
| 2011/0203297 | A1 | 8/2011 | Oberweis |
| 2011/0220531 | A1 | 9/2011 | Meether et al. |
| 2011/0289958 | A1 | 12/2011 | White et al. |
| 2011/0290792 | A1 | 12/2011 | Krzak et al. |
| 2012/0043289 | A1 | 2/2012 | Brown et al. |
| 2013/0200083 | A1 | 8/2013 | Cunningham |
| 2013/0228583 | A1 | 9/2013 | Mayer |
| 2013/0264161 | A1 | 10/2013 | Thompson |
| 2014/0013789 | A1 | 1/2014 | Conrad et al. |
| 2014/0054195 | A1 | 2/2014 | Hallman |
| 2014/0124406 | A1 | 5/2014 | Ishikawa et al. |
| 2014/0131225 | A1 | 5/2014 | Couch, I et al. |
| 2014/0248003 | A1 | 9/2014 | Mogil et al. |
| 2015/0068242 | A1 | 3/2015 | Patstone |
| 2015/0158539 | A1 | 6/2015 | Jensen et al. |
| 2015/0175338 | A1 | 6/2015 | Culp et al. |
| 2015/0210444 | A1 | 7/2015 | Mercado et al. |
| 2015/0241107 | A1 | 8/2015 | Mech |
| 2015/0298886 | A1 | 10/2015 | Knight et al. |
| 2015/0369529 | A1 | 12/2015 | Monroe |
| 2016/0023837 | A1 | 1/2016 | Furneaux et al. |
| 2016/0059990 | A1 | 3/2016 | Patikas-Bryant |
| 2016/0101924 | A1 | 4/2016 | Mitchell et al. |
| 2016/0176577 | A1 | 6/2016 | Frankenberg et al. |
| 2016/0257471 | A1 | 9/2016 | Rud |
| 2016/0257479 | A1 | 9/2016 | Seiders et al. |
| 2016/0279840 | A1 | 9/2016 | French et al. |
| 2016/0347507 | A1 | 12/2016 | Kendrick |
| 2016/0355319 | A1 | 12/2016 | Stephens |
| 2017/0001785 | A1 | 1/2017 | Ripley et al. |
| 2017/0023289 | A1 | 1/2017 | Anderson |
| 2017/0073146 | A1 | 3/2017 | Kuhn et al. |
| 2017/0073147 | A1 | 3/2017 | Kuhn |
| 2017/0115046 | A1 | 4/2017 | Blezard et al. |
| 2017/0121059 | A1 | 5/2017 | Faris |
| 2017/0233139 | A1 | 8/2017 | Averill |
| 2017/0245486 | A1 | 8/2017 | Larson et al. |
| 2017/0305639 | A1 | 10/2017 | Kuhn et al. |
| 2017/0314836 | A1 | 11/2017 | Donnell et al. |
| 2017/0350635 | A1 | 12/2017 | Thirumurugavel |
| 2018/0009101 | A1 | 1/2018 | Piccininni et al. |
| 2018/0015938 | A1 | 1/2018 | DeFrancia |
| 2018/0016060 | A1 | 1/2018 | Peach et al. |
| 2018/0141718 | A1 | 5/2018 | Ahlström et al. |
| 2018/0141739 | A1 | 5/2018 | Hengen |
| 2018/0149400 | A1 | 5/2018 | Valencia |
| 2018/0184775 | A1 | 7/2018 | Altschul et al. |
| 2018/0186547 | A1 | 7/2018 | Morine et al. |
| 2018/0186550 | A1 | 7/2018 | Morine et al. |
| 2018/0187962 | A1 | 7/2018 | Stollenwerck, III |
| 2018/0202700 | A1 | 7/2018 | Ansted et al. |
| 2018/0263346 | A1 | 9/2018 | Stephens |
| 2018/0290814 | A1 | 10/2018 | Smith |
| 2018/0335241 | A1 | 11/2018 | Li et al. |
| 2018/0346229 | A1 | 12/2018 | Guerdrum et al. |
| 2018/0353379 | A1 | 12/2018 | Chou et al. |
| 2018/0360178 | A1 | 12/2018 | Bungert |
| 2019/0023480 | A1 | 1/2019 | Lin |
| 2019/0092554 | A1 | 3/2019 | Rogers et al. |
| 2019/0144164 | A1 | 5/2019 | Breyburg |
| 2020/0102126 | A1 | 4/2020 | Guerdrum et al. |
| 2020/0109889 | A1 | 4/2020 | Kieling et al. |
| 2020/0165055 | A1 | 5/2020 | Barfoot et al. |
| 2020/0189794 | A1 | 6/2020 | Pefley et al. |
| 2021/0016955 | A1 | 1/2021 | Morine et al. |

FOREIGN PATENT DOCUMENTS

| | | | |
|---|---|---|---|
| WO | 2006007266 | A2 | 1/2006 |
| WO | 2006009537 | A1 | 1/2006 |
| WO | 2014105962 | A1 | 7/2014 |
| WO | 2016154105 | A1 | 9/2016 |

OTHER PUBLICATIONS amazon.com, "Farberware 5190590 3-piece cutting board set," dated Jul. 23, 2011, downloaded from https ://www.amazon.com/Farberware-5190590-3-Piece-Plastic-Assorted/dp/80731KDNM P/ref=cm_cr_arp _d_product_top?ie=UTF8 Mar. 11, 2019, 8 pages.

Best Buy, "OtterBox Separator for Venture Coolers—Slate Gray," downloaded from https://www.bestbuy.com/site/otterbox-separator-for-venture-coolers-slate-gray/5824901.p?sku Id=5824901 Nov. 4, 2018, 5 pages.

Best Cooler Reviews, Best Folding and Collapsible Cooler—It's All About Convenience, downloaded from https://bestcooler.reviews/best-folding-collapsible-cooler/ Jan. 15, 2018, 8 pages.

Clevermade, CleverMade CleverCrates 45 Liter Collapsible Storage Bin/Container; Grated Wall Utility Basket/Tote, Royal Blue, downloaded from https://www.amazon.com/CleverMade-CleverCrates-Collapsible-Storage-Container/dp/B00UM4D63W/ref=sr_1_8?ie=UTF8&qid=1516048768&sr=8-8&keywords=collapsible%2Bmilk%2Bcrate&th=1 Jan. 15, 2018, 13 pages.

Coleman, 75 Can Collapsible Sport Cooler, downloaded from https://www.coleman.com/large-sport-collapsible/2000015225.html Jan. 15, 2018, 3 pages.

Digital Trends, "The new Venture coolers from Otterbox . . . ", Posted May 9, 2017.(https://www.digitaltrends.com/outdoors/otterbox-venture-coolers/).

Duluth Trading Co, Folding Milk Crate, downloaded from https://www.duluthtrading.com/store/product/folding-milk-crate-78536.aspx on Jan. 15, 2018, 6 pages.

Fulton, Wil, All the Major Meal Delivery Services, Tested and Ranked, dated Oct. 7, 2016, downloaded from https://www.thrillist.com/eat/nation/best-meal-delivery-services-food-subscription-boxes-ranked on Jan. 15, 2018, 18 pages.

Ice Chest Guide, "Top 10 Best Soft Cooler Reviews and Buying Guide for 2018", downloaded from http://www.icechestguide.com/top-10-best-soft-cooler-reviews-and-buying-guide.html Jan. 25, 2018, 12 pages.

Igloo, Marine Ultra TM Collapse and Cool TM 50, downloaded from https://www.igloocoolers.com/products/61582-marine-ultra-collapse-and-cool-50-can-cooler-bag-white Jan. 15, 2018, 4 pages.

Kelty Folding Cooler, downloaded from https://www.kelty.com/folding-cooler/ Jan. 18, 2018, 6 pages.

Morris, David Z., This box opens up new possibilities for fresh food delivery, dated Aug. 3, 2015, downloaded from http://fortune.com/2015/08/03/freshrealm-cold-delivery/ Jan. 15, 2018, 4 pages.

NRS, "NRS Big Sky Cooler Divider at nrs.com," downloaded from https://www.nrs.com/product/4450/nrs-big-sky-cooler-divider Nov. 4, 2018, 4 pages.

(56) References Cited

OTHER PUBLICATIONS

Otterbox, "Cooler Divider OtterBox Venture Cooler Accessory," downloaded from www.otterbox.com/en-us/venture/separator/otr56-cooler-acc-separator. html#start= 1 Nov. 4, 2018, 4 pages.
OtterBox, "Rugged Venture Coolers", Accessed Jan. 16, 2018. (https://www.otterbox.com/en-us/venture-coolers.html).
Pelican Consumer, Coolers—Hunting, Fishing, Camping, downloaded from http://www.pelican.com/us/en/products/coolers May 8, 2017, 2 pages.
Pelican Products, "70QT Cooler", Accessed Jan. 16, 2018. (http://www.pelican.com/us/en/product/outdoor-heavy-dutycoolers/elite-cooler/cooler/70QT/).
Picnic at Ascot, 396-RB 60 Can Collapsible Rolling Cooler, downloaded from http://www.picnicatascot.com/main/default/ProductsDetail.aspx?id=136 Jan. 15, 2018, 2 pages.
Polar Bear Coolers, "24 Pack Eclipse Cooler," downloaded from http://www.polarbearcoolers.com/product/PB327.html Jan. 30, 2018, 6 pages.
Polar Bear Coolers, "Eclipse Backpack Cooler," downloaded from http://www.polarbearcoolers.com/product/PB397.html Jan. 29, 2018, 4 pages.
REI Co-Op, "Soft-sided Coolers", downloaded from https://www.rei.com/c/soft-sided-coolers?r-c&origin+web&ir=category%3Asoft-sided-coolers%page=1 Jan. 25, 2018, 6 pages.
RTIC, "RTIC Soft Pack Coolers," downloaded form https://www.rticcoolers.com/shop/coolers/softpak Jan. 25, 2018, 16 pages.
RTIC, Cooler Accessories, downloaded May 8, 2017 from http://www.rticcoolers.com/shop/coolers/accessories, 14 pages.
Stay Cool Hot Stuff, Flip-Box XL Collapsible Cooler and Insulation Box, downloaded from https://staycoolhotstuff.com/products/flip-box-xl-collapsible-cooler-and-insulation-box Jan. 18, 2018, 5 pages.
The Cooler Box, "Cordova Coolers vs Yeti—Is This New Cooler Better Than Yeti?", Published Oct. 24, 2016.(http://thecoolerbox.com/cordova-coolers-vs-yeti/).
The Good Housekeeping Institute, Thermos Cold N' Fold Cooler, dated Jul. 2007, downloaded from http://www.goodhousekeeping.com/travel-products/food-cooler-reviews/a28866/thermos-cold-n-fold-cooler-101/ Jan. 18, 2018, 5 pages.
Walmart, ECR4Kids Large Vented Collapsible Crate, 12pk, downloaded from https://www.walmart.com/ip/ECR4Kids-Large-Vented-Collapsible-Crate-12pk/34702630 on Jan. 15, 2018, 7 pages.
Yeti Coolers, "Hopper Soft Sided Portable Coolers," downloaded from https://www.yeti.com/soft-coolers Jan. 25, 2018, 6 pages.
Yeti Coolers, "Tundra Cooler Divider," dated Mar. 11, 2014, downloaded from https://www.yeti.com/en_US/accessories/tundra-dividers/DV.html?cg id =accessories# Mar. 11, 2019, 9 pages.
Yeti Coolers, Tundra Cooler Divider, downloaded from www.yeti.com/tundra-dividers May 8, 2017, 4 pages.
Yeti Coolers, Tundra Ice Chests, downloaded from http://yeti.com/tundra May 8, 2017, 7 pages.
Yeti Coolers, Yeti Accessories & Parts, downloaded from http://yeti.com/accessories May 8, 2017, 5 pages.

* cited by examiner

INSULATED SHIPPING CONTAINER

CROSS REFERENCE TO RELATED APPLICATIONS

This application claims priority to U.S. patent application Ser. No. 16/904,792, filed Jun. 18, 2020, which claims priority to U.S. Provisional Patent Application No. 62/874,016, filed Jul. 15, 2019, all of which are hereby incorporated by reference in their entireties.

FIELD

This disclosure relates generally to portable insulated containers for objects, such as shipping containers for food and/or beverages.

BACKGROUND

It is often desirable to ship food and/or beverages that are required to be maintained within a specified or predetermined temperature range. Exposure, particularly to temperatures outside the predetermined temperature range, may result in the degradation or spoilage of the food and/or beverage being shipped. For example, it may be desirable to maintain bottles of wine within a preferred temperature range during shipping, such as between 35° F. and 70° F. to prevent degradation of the wine. It may also be desirable to provide some degree of protection to food or beverage being shipped, such as protection from impact.

Currently available shipping containers may suffer from one or more disadvantages, such as requiring large volumes of ice or other coolant to maintain the temperature of the shipped food and/or beverage within the predetermined range. Some products may not be typically shipped during certain times of the year, such as summer when the environmental temperature may be too warm, or winter, when the environmental temperature may be too cold. Even during more moderate environmental temperatures, food and/or beverages may not be shipped if the expected delivery time exceeds the capacity of the shipping container to maintain the predetermined temperature range. In addition, the placement of the coolant within current shipping containers may lead to the food and/or beverage in different positions within the shipping containers being exposed to a variety of temperature histories.

It is therefore desirable to be able to ship food and/or beverages in a container providing more even temperature distribution within the cavity or chamber and with a high degree of insulation to better maintain the temperature within the chamber within a predetermined temperature range.

SUMMARY

Insulated shipping containers are used for a variety of purposes and in conjunction with a variety of activities. A container may be insulated to assist in keeping one or more items cool, cold, frozen, warm, or hot. The container may also be used to protect one or more items from damage, bumps, scratching, impact, water, rain, snow, mud, dust, dirt, light, visibility, theft, chemicals, and/or contaminants. While most of the examples discussed herein are discussed with respect to a container for keeping the contents cool, it should be understood that the techniques and features disclosed herein are applicable to other types of storage containers or temperature control containers. The containers disclosed herein may be configured to be carried or transported in a plurality of manners or configurations.

In one example, a portable insulated container is used for transporting a plurality of bottles wherein the plurality of the bottles includes bottles having two or more bottle shapes and includes bottles having two more bottle sizes. The portable insulated container includes an outer shell and a temperature control pack. The portable insulated container also includes a first insert portion that fits inside the outer shell and a second insert portion that also fits inside the outer shell and is configured to engage with the first insert portion to form a plurality of insulated cavities. The plurality of insulated cavities include a temperature control pack cavity for receiving the temperature control pack along with three or more separate bottle storage cavities. Each of the three or more bottle storage cavities is configured for receiving a respective one of the plurality of the bottles and each of the three or more bottle storage cavities is configured for receiving at least two of the bottle sizes and at least two of the bottle shapes. Each of the three or more bottle storage cavities may also be equidistant from the temperature control pack cavity.

In another example, a portable insulated shipping container includes an insulated body having an internal cavity configured for storing items, an insulated lid configured to releasably engage the insulated body to close the internal cavity, and an insert positioned within the internal cavity. The insulated cavity is internal cavity at least partially bounded by a bottom and a plurality of walls. The insert includes three or more cavities each configured to receive an item. The three or more cavities are spaced around a central temperature control cavity configured to receive at least a portion of a temperature control pack. A distance between the central temperature control cavity and each cavity of the three or more cavities is the same for each cavity.

In another example, an insulated container for storing or shipping bottles includes a body and a lid. The body has a shell and an insert portion that is formed from an insulating material. The lid also has a shell and an insert portion formed from the insulating which meets the insert portion of the body to form enclosed cavities when the insulated container is in a closed position. The internal cavities include a temperature control pack cavity and four or more separate bottle storage cavities distributed around the temperature control pack cavity. Each of the four or more bottle storage cavities is configured for receiving a bottle from among three or more different bottle types. Each of the three or more bottle types has a different shape and/or size than each of the other three or more bottle types. Each of the four or more bottle storage cavities includes at least three bottle stop features on one or more internal surfaces. Each bottle stop feature is associated with a different one of the three or more bottle types.

Other variations and embodiments are possible, including variations and embodiments which do not necessarily include all of the elements described above and/or variations and embodiments which may include additional elements.

DETAILED DESCRIPTION

Figure 1:
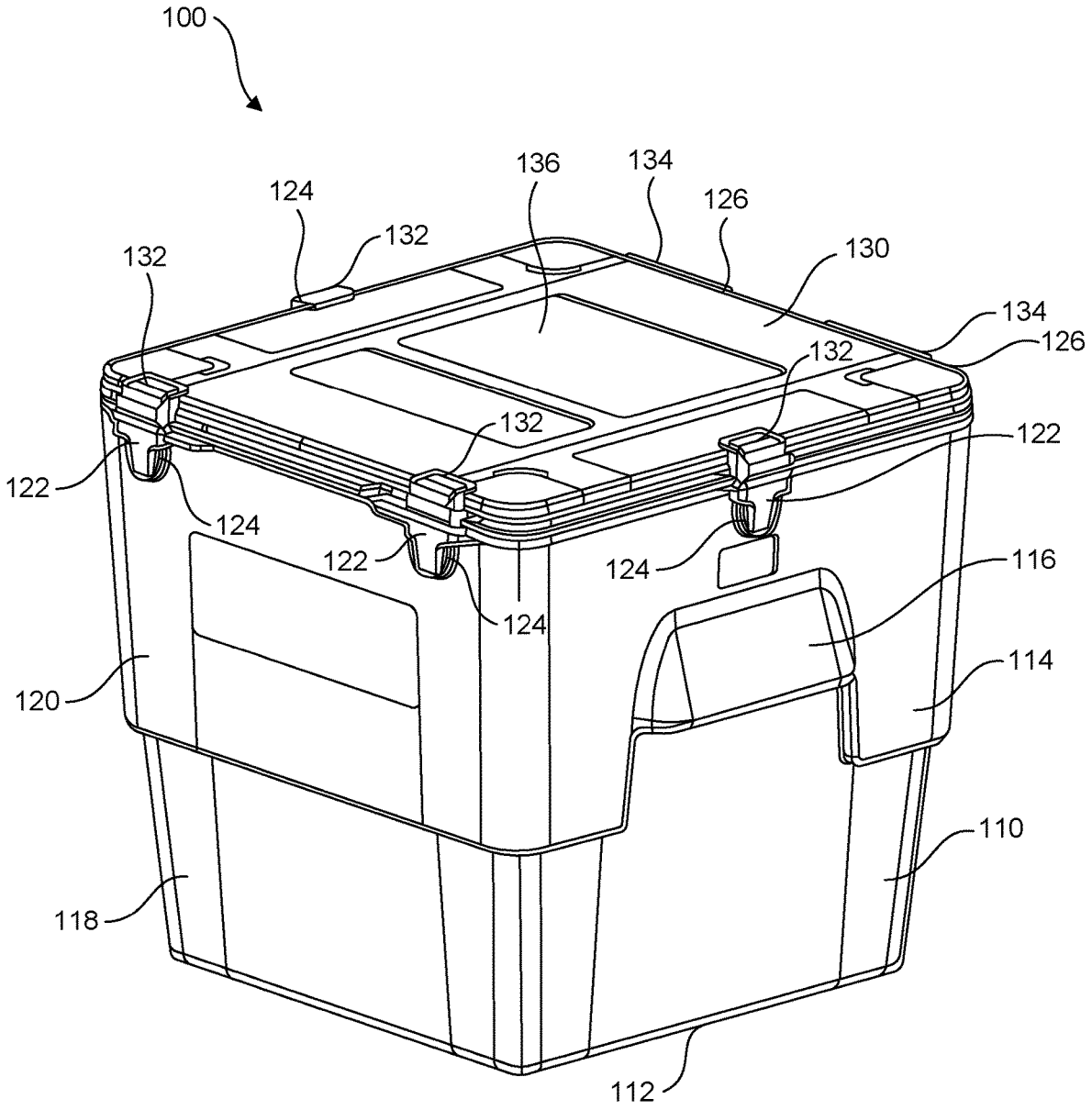
FIG. 1 illustrates a portable insulated shipping container.

FIG. 1 illustrates an exemplary portable insulated shipping container 100. Container 100 includes a body 110 and a lid 130. Body 110 includes a bottom surface 112 and a plurality of walls 114. In some embodiments, one or more walls 114 and/or lid 130 includes a handle 116 to assist with carrying container 110. In the embodiment illustrated in FIG. 1, body 110 has a substantially square shape. In other embodiments, body 110 may have another suitable shape, such as rectangular, round, or hexagonal.

In some embodiments, one or more walls 114 each include a lower portion 118 and an upper portion 120. In some embodiments, lower portion 118 may be set back or tapered in a direction towards bottom surface 112, allowing at least a portion of lower portion 118 to nest inside the corresponding upper portion 120 of a second container 100. By nesting a portion of lower portion 118 into a second container 100, the amount of space necessary to store and/or ship empty containers 100 may be reduced.

Body 110 includes one or more latch receivers 122 for releasably receiving a latch 124. Latch 124 illustratively extends through a lid receiver 126 in lid 130 and latch receiver 122 in upper portion 120 of body 110 to releasably attach lid 130 to body 110. Exemplary latches 122 are disclosed in U.S. Provisional Application No. 62/737,231, filed Sep. 27, 2018, the disclosures of which are hereby incorporated by reference in their entirety. Latches 124 may provide a closure that is waterproof, water-resistant, airtight, childproof, child resistant, animal proof, and/or animal resistant. Latches 124 may include one or more components made of plastic, metal, wood, ceramic, rubber, and/or silicone. Further, latches 124 may include a locking mechanism or may include an interface for use with one or more locks or access control devices, such as an electronic lock or a seal which indicates opening or tampering. In still other embodiments, a suitable clasp, fastener, clip, snap, or lever is used to releasably attach lid 130 to body 110.

In some embodiments, lid 130 is fully removably from body 110. In other embodiments, lid 130 is pivotably or rotatably attached to body 110 with one or more hinges 126. In the illustrated embodiment, hinges 126 may be permanently or releasably attached to upper portion 130 of body 110, and are received within a corresponding hinge receiver 134 in lid 130.

Figure 2:
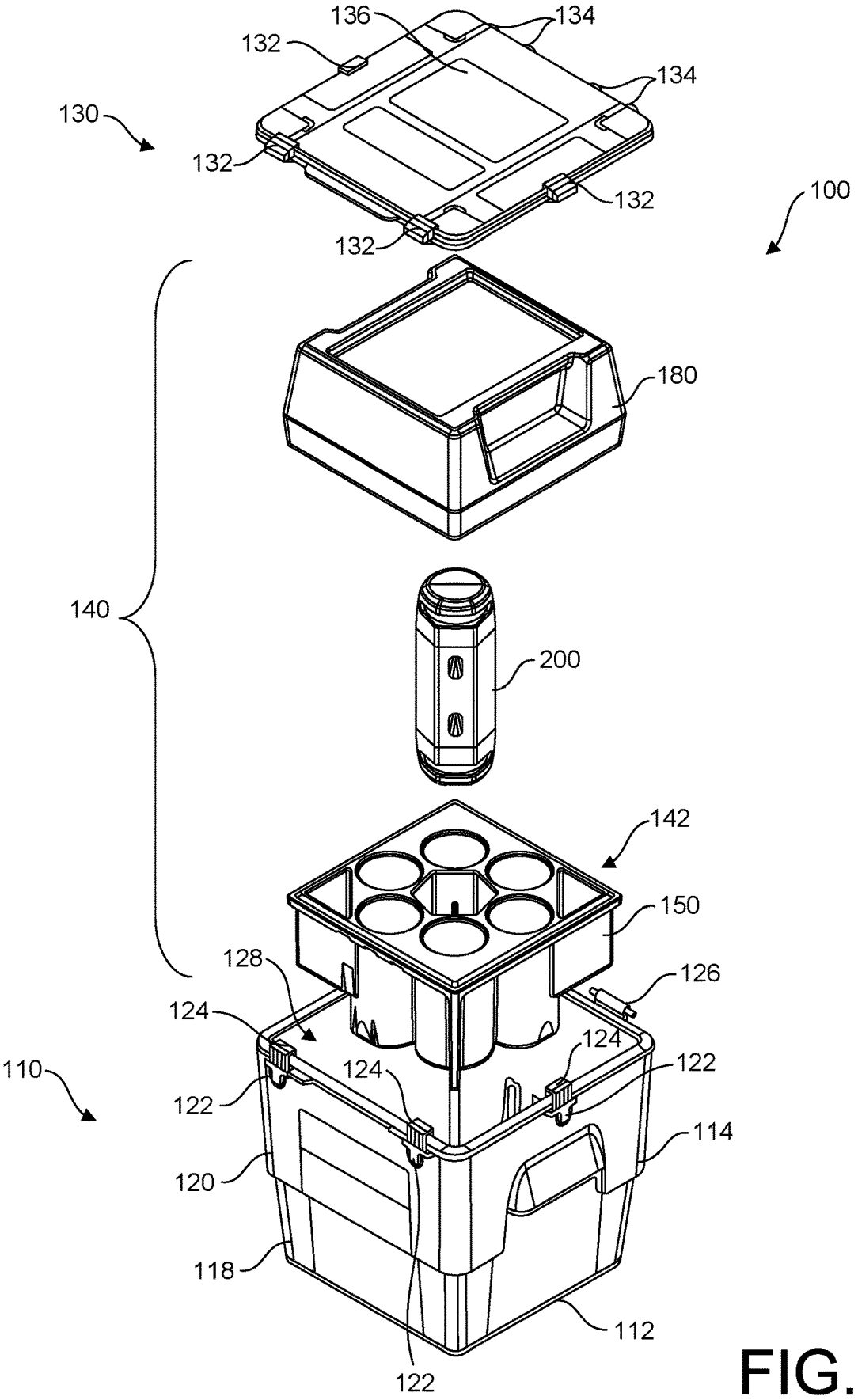
FIG. 2 illustrates an exploded view of the portable insulated shipping container of FIG. 1.

Referring next to FIG. 2, body 110 provides a cavity 128, storage compartment, storage volume, or storage area (see FIG. 2) which is accessible by removing lid 130 from body 110. Body 110 and/or lid 130 may be made from one or more plastics, food grade plastics, foams, metals, and/or natural materials. Body 110 and/or lid 130 may be molded, injection molded, roto-molded, pressure-formed, 3-D printed, machined, and/or stamped. Each of body 110 and lid 130 may comprise a single component or may be made of multiple components. Body 110 and/or lid 130 may include a gasket or seal to seal the cavity 128 from the external environment when lid 130 is attached to body 110.

Body 110 and/or lid 130 may be rigid or may contain portions that are flexible, bendable, soft, compliant, stretchable, and/or compressible. In some cases, one or more portions of container 100 may be partially or fully collapsible when not in use. Various portions of container 100 may be attached using one or more methods including sewing, gluing, adhesive, electro-welding, thermoplastic welding, co-molding, melting, and/or fasteners.

Body 110 and/or lid 130 may also include one or more information panels, such as label receiver 136. Label receiver 136 may be a pouch, pocket, slot, or surface for storing or displaying information about the contents of container 100 and/or shipping information for container 100. Label receiver 136 may include a substantially clear window or a substantially transparent window or may be a recessed area. The contents information and/or shipping information may be removable, changeable, or replaceable. One or more parts of container 100 and/or container 100 may be waterproof, water-resistant, abrasion resistant, tear resistant, and/or puncture resistant. In some examples, one or more of body 110 and lid 130 may be referred to as a shell, a shell portion, an outer shell, and/or an outer shell portion.

Container 100 may also include one or more attachment areas or attachment points for removably attaching one or more accessories or other items to container 100. Attachment points may include any of a variety of attachment mechanisms, structures, elements, or features including any described in U.S. patent application Ser. No. 15/398,468, filed Jan. 4, 2017, which is hereby incorporated by reference in its entirety.

Figure 3:
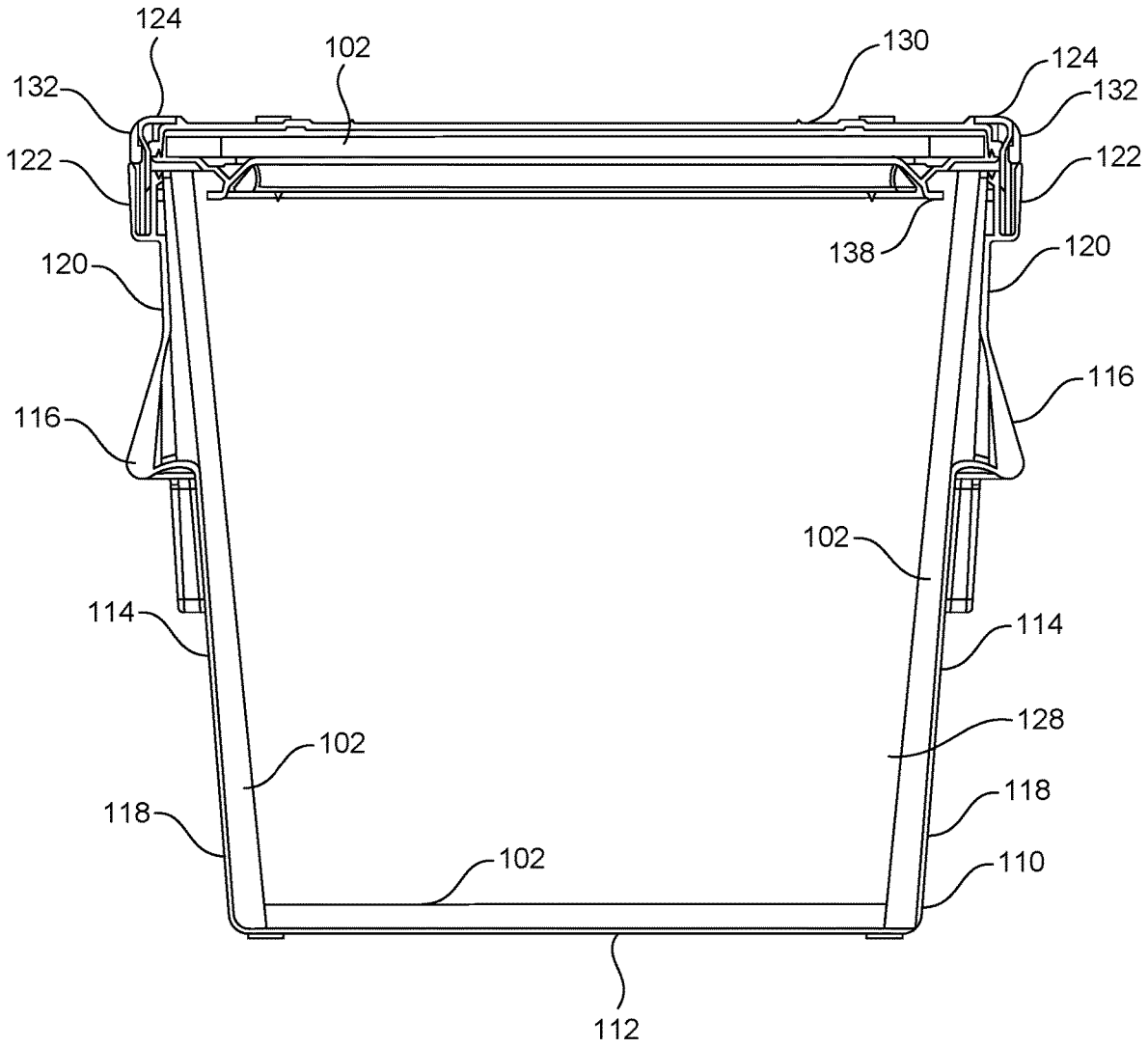
FIG. 3 illustrates a cross-sectional view of a base and attached lid of the portable insulated shipping container of FIG. 1.

FIG. 3 illustrates a sectional view of body 110 with lid 130 attached. A lower surface 138 of lid 130 partially extends into cavity 128. Each of body 110 and lid 130 may also include insulation or one or more insulating elements or panels 102, such as foam, expanding foam, expanded polypropylene, expanded polystyrene, closed cell foam, structural foam, spray foam, paper pulp, blanket materials, one or more evacuated cavities, one or more vacuum insulated panels, or combinations thereof. In some embodiments, the bottom surface 112, one or more of the walls 114, and/or the lid 130 each includes one or more insulating elements or panels 102. In the embodiment illustrated in FIG. 3, the bottom surface 112, the walls 114, and the lid 130 each includes a vacuum insulated panel 102. In some examples, one or more insulating elements or panels 102 may also be replaceable, exchangeable, and/or swappable.

Referring again to FIG. 2, container 100 includes a shipping insert 140. Insert 140 is received within cavity 128 of body 110. In some embodiments, insert 140 may be permanently attached to body 110. In other embodiments, insert 140 is releasably retained within body 110, such as by one or more latches, clasps, fasteners, clips, levers, detents, or temporary adhesives (not shown in FIG. 2).

Figure 4:
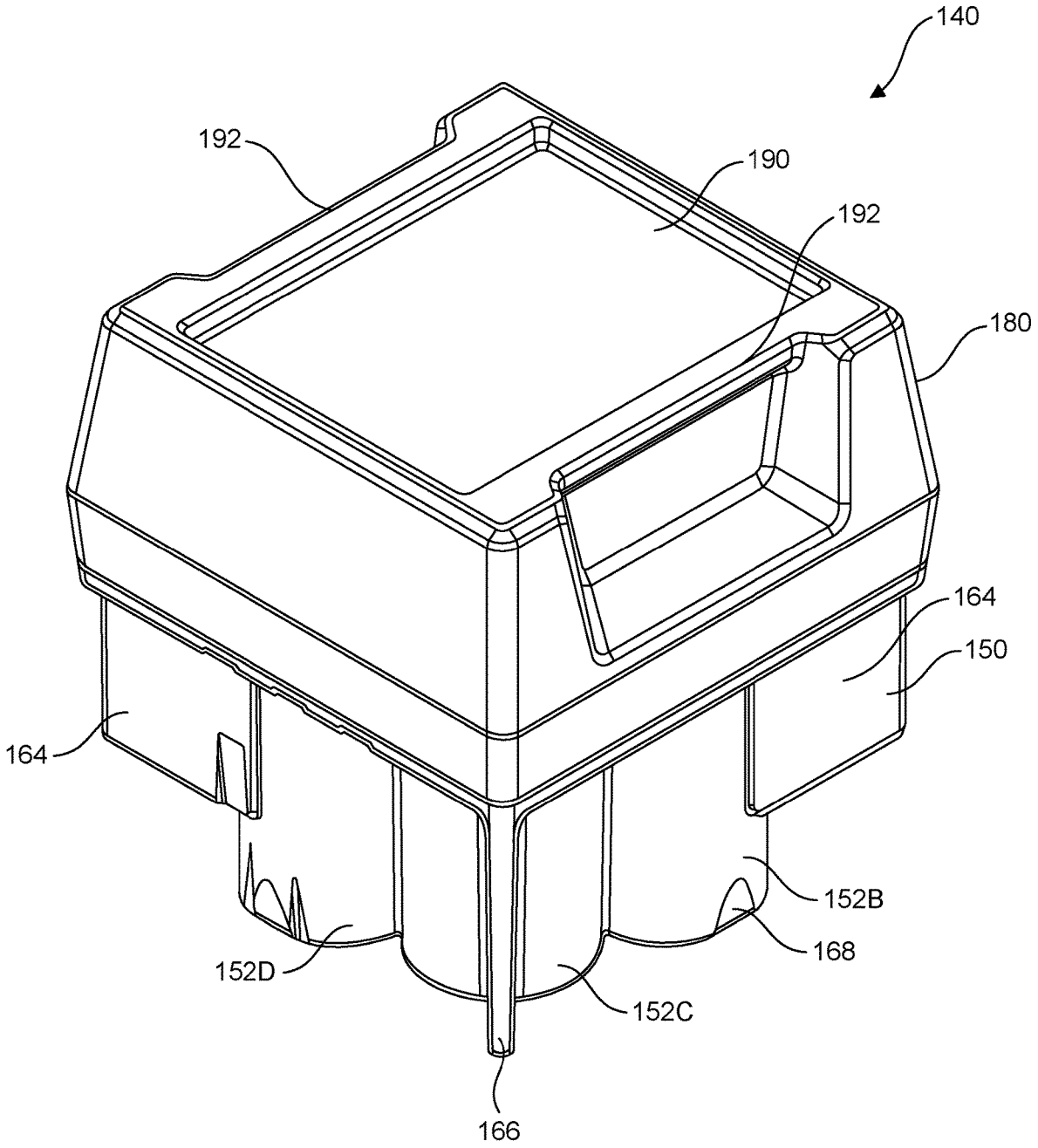
FIG. 4 illustrates a bottle shipping insert of the portable insulated shipping container of FIG. 1.
Figure 5:
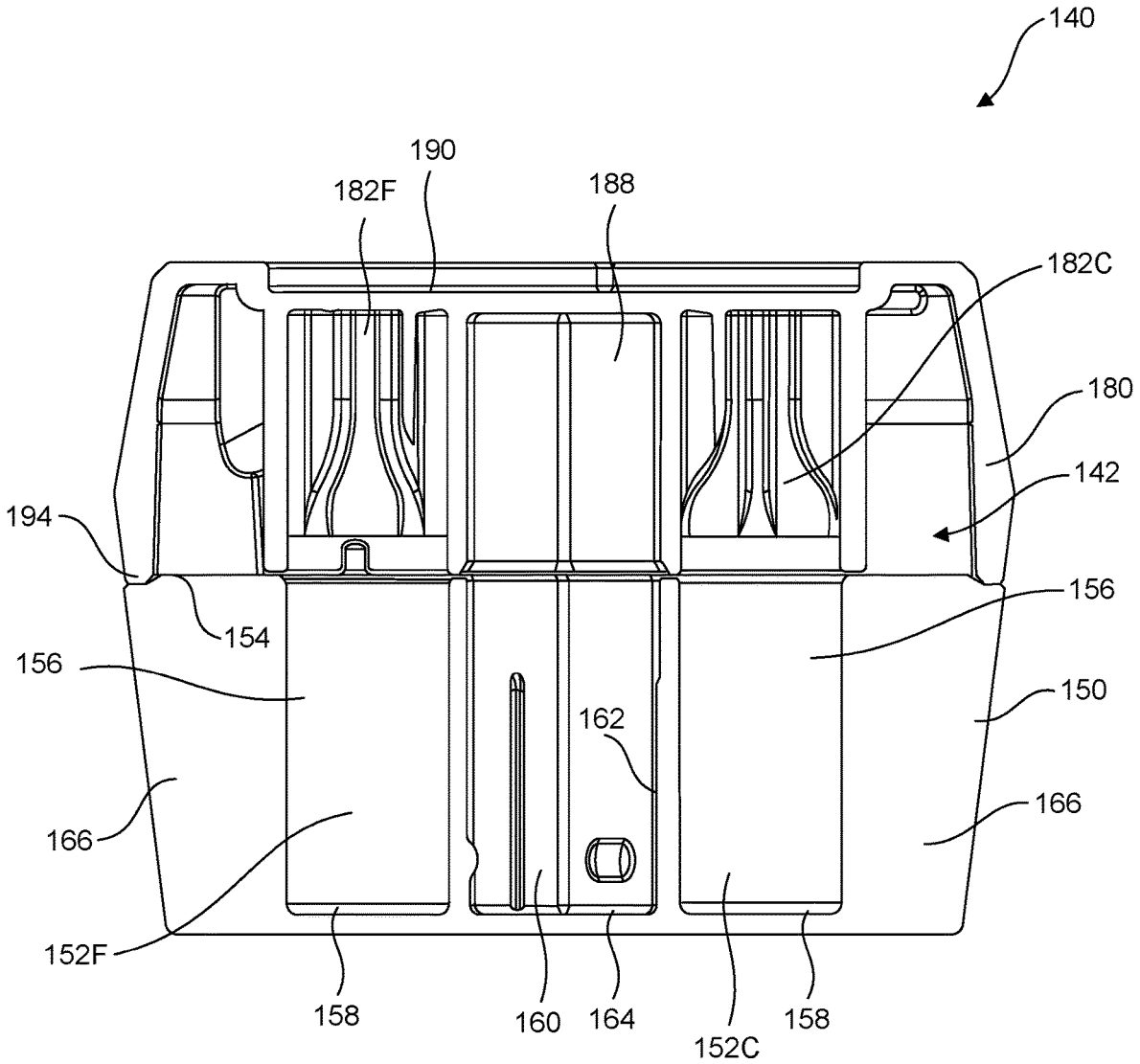
FIG. 5 illustrates a sectional view of the bottle shipping insert of FIG. 4.

As illustrated in FIGS. 4 and 5, shipping insert 140 includes bottle tray 150 and cover 180. Tray 150 and cover 180 may be made from one or more plastics, food grade plastics, metals, foam, expanding foam, expanded polypropylene, expanded polystyrene, closed cell foam, structural foam, spray foam, paper pulp, and/or natural materials. Tray 150 and cover 180 may be molded, injection molded, roto-molded, pressure-formed, 3-D printed, machined, and/or stamped. Each of tray 150 and cover 180 may comprise a single component or may be made of multiple components. Tray 150 and cover 180 may include a gasket or seal to seal an internal cavity 142 (see FIG. 2) from cavity 128 of base 110. Each of tray 150 and cover 180 may also be referred to as an insert, insert member, or insert portion.

Figure 6:
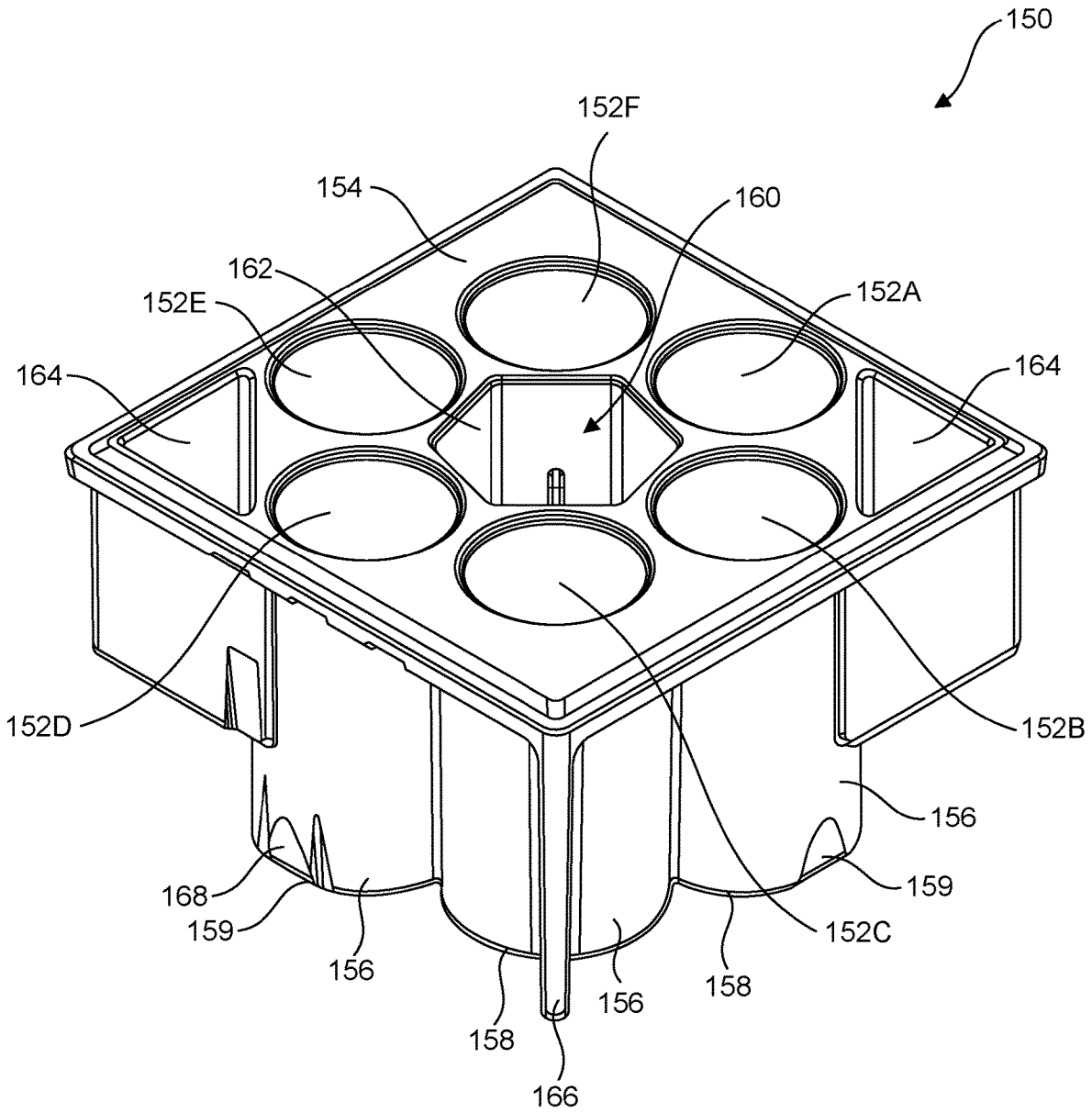
FIG. 6 illustrates a bottom receiving portion of the bottle shipping insert of FIG. 4.
Figure 7:
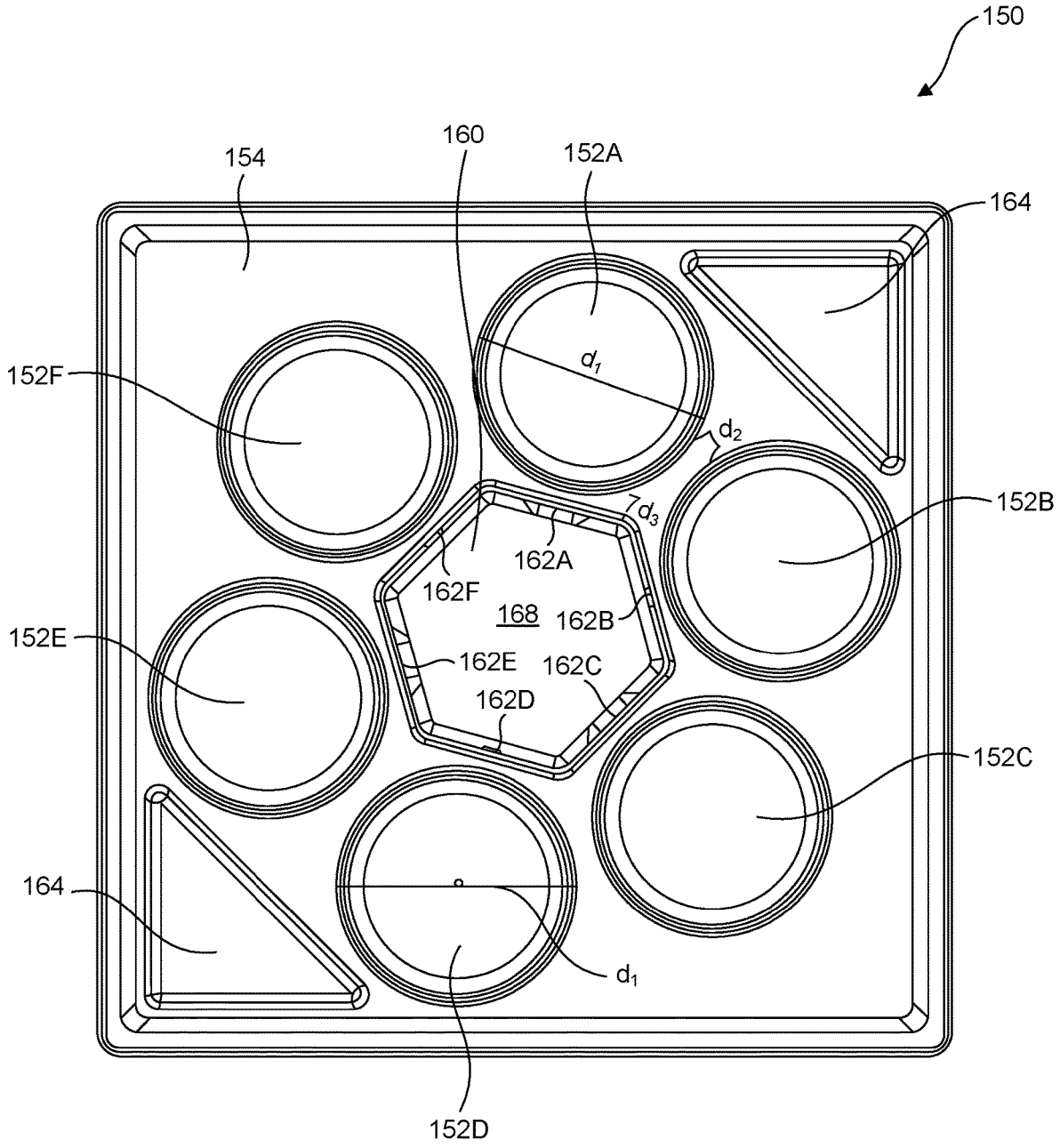
FIG. 7 illustrates a top view of the bottom receiving portion of FIG. 6.

Referring next to FIGS. 6 and 7, an exemplary tray 150 is illustrated. In the illustrated embodiment, tray 150 includes six cavities 152, labeled 152A-152F. Each cavity 152 is illustratively configured to receive an item for shipping in container 100, such as a bottle, or even more particularly, a bottle of wine.

Tray 150 includes an upper surface 154 into which the cavities 152 are formed. Each cavity 152 extends from the upper surface 154 along one or more cavity walls 156 to a bottom 158. In the embodiment illustrated in FIGS. 6 and 7, each cavity 152 has a substantially cylindrical shape. Cavities 152 having other shapes, including shapes having a round, triangular, square, rectangular, diamond, pentagonal, hexagonal, octagonal, or other polygonal cross section are may also be used. In some embodiments, an opening 168 may be formed in one or more walls 156 and/or bottom 158 to allow air to exit cavity 152 as the bottle is being inserted.

Cavities 152 are arranged around a central temperature control cavity 160, which may also be referred to as temperature control pack cavity. Temperature control cavity 160 includes one or more walls 162, each extending from upper surface 152 of tray 150 to a bottom 168.

In the illustrated embodiment, tray 150 includes six cavities 152, namely cavities 152A-152F, and temperature control cavity 160 includes six corresponding walls 162, namely walls 162A-162F (see FIG. 7). In another exemplary embodiment, tray 150 includes three cavities 152 and temperature control cavity 160 has a triangular cross-section with three walls 162. In other exemplary embodiments, tray 150 includes four cavities 152 and temperature control cavity 160 has a square, rectangular, or diamond cross-section with four walls 162. In another exemplary embodiment, tray 150 includes five cavities 152 and temperature control cavity 160 has a pentagonal cross-section with five walls 162. In another exemplary embodiment, tray 150 includes six cavities 152 and temperature control cavity 160 has a hexagonal cross-section with six walls 162. In other exemplary embodiments, tray 150 includes seven cavities 152 and temperature control cavity 160 has a heptagonal cross-section with seven walls 162. In other exemplary embodiments, tray 150 includes eight cavities 152 and temperature control cavity 160 has an octagonal cross-section with seven walls 162. In other exemplary embodiments, tray 150 includes more than eight cavities 152 and temperature control cavity 160 has a cross-section having a corresponding number of walls 162 as cavities 152. In other exemplary embodiments, tray 150 includes three, four, five, six, seven eight, or more cavities 152 and temperature control cavity 160 has a circular cross-section with a single wall 162.

Each cavity 152 has a diameter, indicated in FIG. 7 by $d_1$ for the diameter cavity 152A. In some embodiments, diameter $d_1$ is as little as 1 inch, 2 inches, 3 inches, 4 inches, as great as 5 inches, 6 inches, 7 inches, 8 inches, or greater, or between any two of the foregoing values, such as 1 inch to 8 inches or 3 inches to 5 inches. While the cavities 152 in FIGS. 6 and 7 are illustrated as being circular and of approximately equal size to each other, the improvements herein may be extended to configurations in which the cavities or storage areas have different sizes or shapes, including different from each other.

Each cavity 152 is separated from an adjacent cavity 152 by a distance, indicated in FIG. 7 by $d_2$ for the distance between cavity 152A and adjacent cavity 152B. In some embodiments, distance $d_2$ is as little as 0.2 inches, 0.3 inches, 0.4 inches, 0.5 inches, as great as 0.6 inches, 0.7 inches, 0.8 inches, 0.9 inches, 1 inch, or greater, or between any two of the foregoing values, such as 0.2 inches to 1 inch or 0.4 inches to 0.6 inches.

In some embodiments, $d_2$ is about the same size or smaller than $d_1$. In some embodiments, a ratio of $d_1$ to $d_2$ is 1:1, 2:1, 3:1, 4:1, 5:1, 6:1, 8:1, 10:1, or greater, or between any two of the foregoing values, such as 1:1 to 10:1 or 4:1 to 10:1.

Each cavity 152 is separated from the closest wall 162 of the central temperature control cavity 160 by a distance, indicated in FIG. 7 by $d_3$, between cavity 152A and corresponding wall 162A. In some embodiments, distance $d_3$ is as little as 0.2 inches, 0.3 inches, 0.4 inches, 0.5 inches, as great as 0.6 inches, 0.7 inches, 0.8 inches, 0.9 inches, 1 inch, or greater, or between any two of the foregoing values, such as 0.2 inches to 1 inch or 0.4 inches to 0.6 inches.

In some embodiments, the distance $d_3$ for each cavity 152 is the same for all cavities 152 in tray 150. Without wishing to be held to any particular theory, Examples 1-3 below illustrate that providing a consistent distance $d_3$ between all cavities results in a more consistent temperature for all items positioned within the cavities 152 compared to geometries in which $d_3$ differs among cavities 152. Examples 1-3 below further illustrate that providing a consistent distance $d_3$ between all cavities results in longer period of temperature control compared to geometries in which $d_3$ differs among cavities 152.

In some embodiments, $d_3$ is about the same size or smaller than $d_1$. In some embodiments, a ratio of $d_1$ to $d_2$ is 1:1, 2:1, 3:1, 4:1, 5:1, 6:1, 8:1, 10:1, or greater, or between any two of the foregoing values, such as 1:1 to 10:1 or 4:1 to 10:1.

In some embodiments, $d_3$ is about the same size as $d_2$. In some embodiments, $d_3$ is larger than $d_2$. In some embodiments, $d_3$ is smaller than $d_2$. In some embodiments, a ratio of $d_2$ to $d_3$ is 10:1, 8:1, 6:1, 5:1, 4:1, 3:1, 2:1, 1:1, 1:2, 1:3, 1:4, 1:5, 1:6, 1:8, 1:10, or between any two of the foregoing values, such as 10:1 to 1:10 or 2:1 to 1:2.

In some embodiments, tray 150 includes one or more additional cavities 164 not arranged around central cavity 160. Additional cavities 164 may be used for storing other items for shipping, such as items that require less, little, or no temperature control during shipping as compared to the items shipped in cavities 152. The walls forming additional cavities 164 may be sized to snugly position tray 150 within base 110 of container 100, preventing tray 150 from moving during shipping.

In some embodiments, tray 150 includes one or more fins 166 each extending outward from a cavity 152, such as opposite cavities 152C and 152F. Fins 166 may be sized to snugly position tray 150 within base 110 of container 100, preventing tray 150 from moving during shipping.

Figure 8:
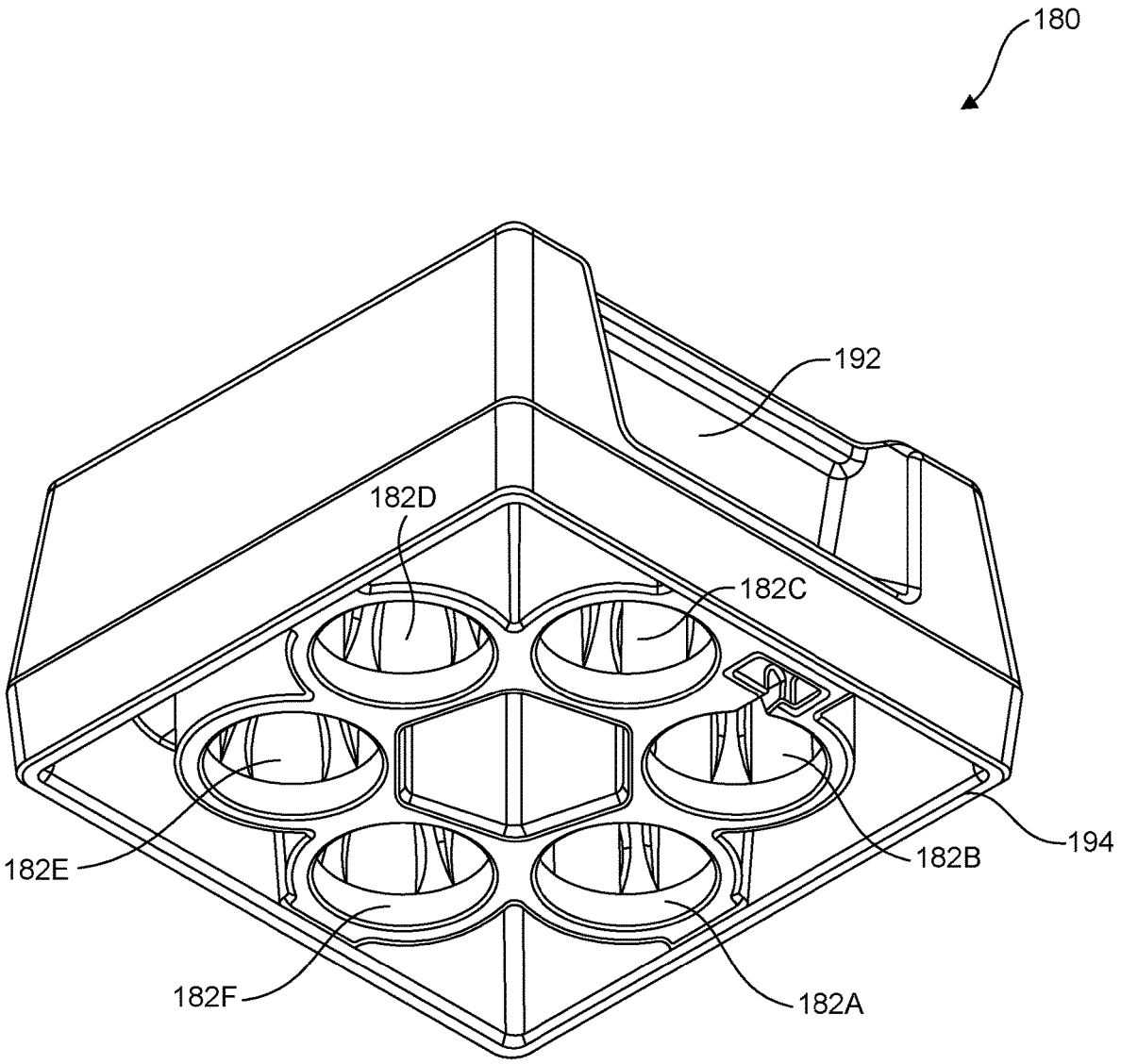
FIG. 8 illustrates a top receiving portion of the bottle shipping insert of FIG. 4.
Figure 9:
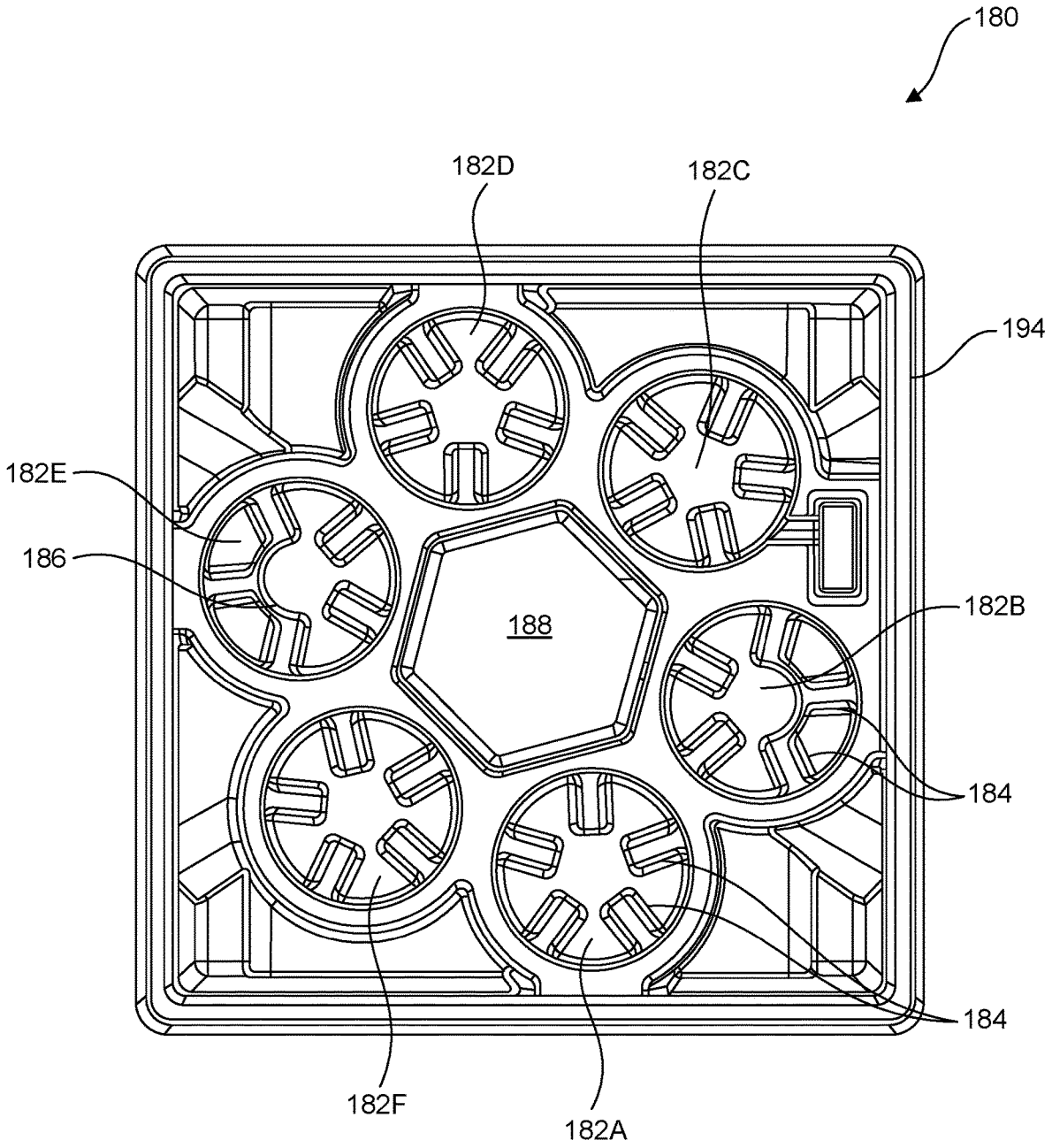
FIG. 9 illustrates a bottom view of the top receiving portion of FIG. 8.

Referring next to FIGS. 8 and 9, an exemplary cover 180 for shipping insert 140 is illustrated. In the illustrated embodiment, cover 180 includes six upper cavities 182, labeled 182A-182F. The upper cavities 182 each correspond to a cavity 152 of tray 150 and is illustratively configured to receive an upper portion of the item for shipping received in the corresponding cavity 152.

As illustrated in FIG. 9, each cavity 182 may include one or more stabilizing elements, such as flexible fins 184 or surfaces 186. The stabilizing elements, such as fins 184 and surfaces 186, are configured to receive an upper portion of the item positioned within upper cavity 182, such as the shoulder and/or neck of a wine bottle.

Cover 180 includes an upper central temperature control cavity 188, which may also be referred to as temperature control pack cavity. Upper temperature control cavity 188 illustratively has a shape corresponding to the shape of the central temperature control cavity 160 of tray 150.

In some exemplary embodiments, such as that illustrated in FIG. 4, the upper surface 190 of cover 180 includes a recessed portion for receiving the lower surface 138 of lid 130 when shipping insert 140 is positioned within cavity 128.

In some exemplary embodiments, cover 180 includes one or more handles 192 to assist in removing cover 180 from tray 150.

As illustrated in FIG. 5, in some embodiments, an outer perimeter 194 of cover 180 is configured to rest on the top surface 154 of tray 150. In some embodiments, outer perimeter 194 and/or top surface 154 includes one or more seals or gaskets (not shown in FIG. 5). In some embodiments, cover 180 is releasably attached to tray 150, such as by one or more latches, clasps, fasteners, clips, levers, or detents (not shown in FIG. 5). In some embodiments, outer perimeter 194 of cover 180 and top surface 154 of tray 150 form a waterproof, leakproof, and/or odor-proof seal between the internal cavity 142 of shipping insert 140 and the remainder of container 100. In this way, spills of material within shipping insert 140 are prevented from leaking or otherwise intruding into the remainder of container 100 and contents are protected from potential outside contaminants.

Figure 10:
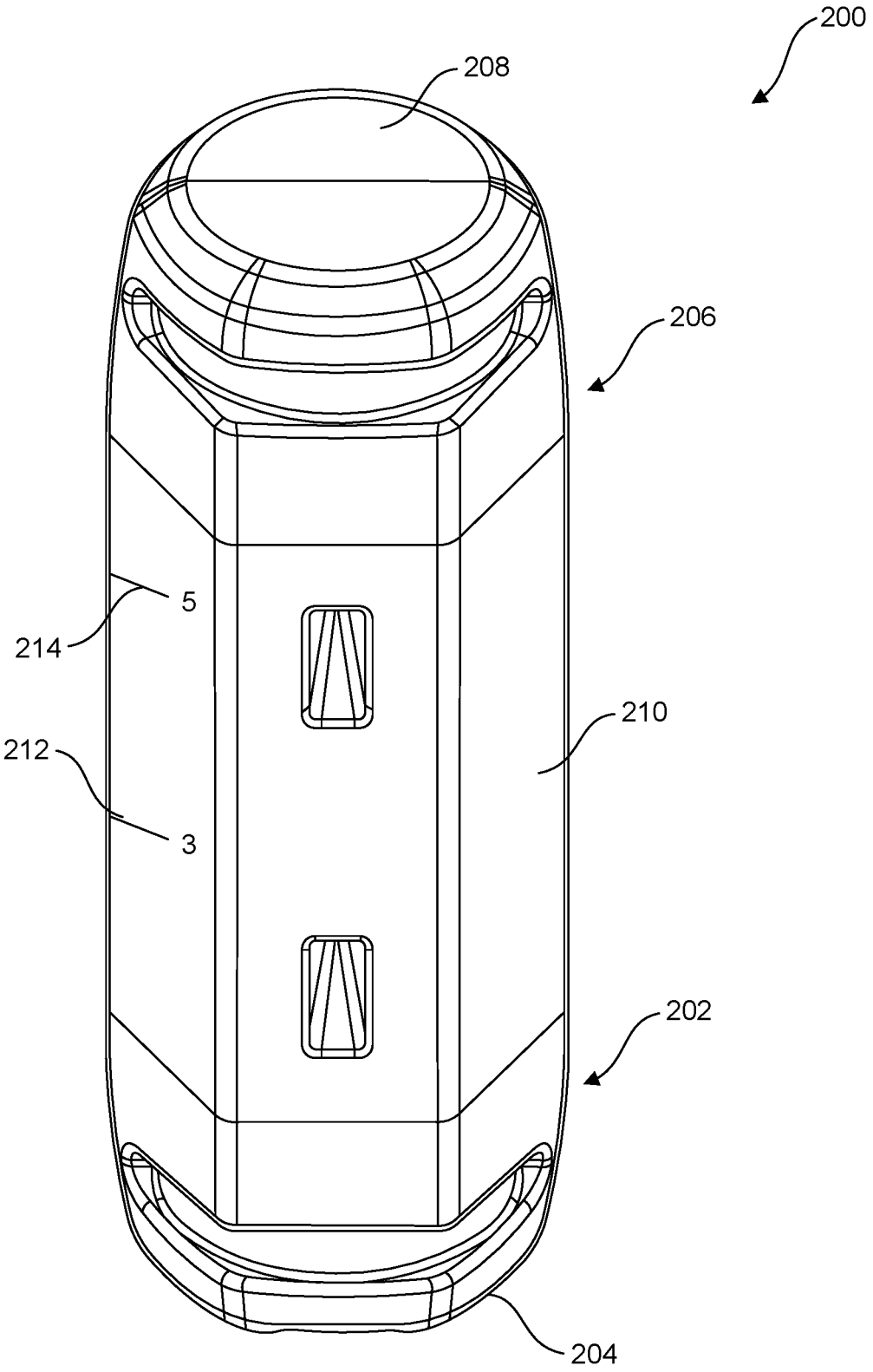
FIG. 10 illustrates an exemplary temperature control pack of the portable insulated shipping container of FIG. 1.

Referring next to FIG. 10, an exemplary temperature control pack 200. Temperature control pack 200 may be made from one or more plastics, food grade plastics, metals, and/or natural materials. Temperature control pack 200 may be molded, injection molded, roto-molded, pressure-formed, 3-D printed, machined, and/or stamped. Temperature control pack 200 may comprise a single component or may be made of multiple components.

Temperature control pack 200 includes a lower portion 202 proximate bottom end 204 and an upper portion 206 proximate top end 208. Lower portion 202 of temperature control pack 200 illustratively has a cross-sectional area corresponding to the cross-section of central temperature control cavity 160 of tray 150, allowing at least a part of lower portion 202 of temperature control pack 200 to be received within central temperature control cavity 160. Upper portion 206 of temperature control pack 200 illustratively has a cross-sectional area corresponding to the cross-section of upper central temperature control cavity 188 of cover 180, allowing at least a part of upper portion 206 of temperature control pack 200 to be received within upper central temperature control cavity 188.

Temperature control pack 200 includes one or more walls 210. In some embodiments, temperature control pack 200 includes the same number of walls as central temperature control cavity 160 of tray 150 and upper central temperature control cavity 188 of cover 180. In other embodiments, temperature control pack 200 includes a single wall and has a circular cross-section configured to fit within central temperature control cavity 160 of tray 150 and upper central temperature control cavity 188 of cover 180.

In some embodiments, temperature control pack 200 is releasably affixed to tray 150 or cover 180 with one or more latches, clasps, fasteners, clips, levers, or detents (not shown in FIG. 10). In other embodiments, temperature control pack 200 is not affixed to tray 150 or cover 180.

An interior of temperature control pack 200 includes one or more temperature control substances. Exemplary temperature control substances include ice packs, cold packs, water, gel packs, instant ice packs, ice, dry ice, hot packs, and/or other thermal items and mixtures thereof. In some embodiments, the temperature control substance may be based on one or more of the substances thermal characteristics, thermal profiles, thermal mass, non-toxicity, or other suitable characteristics.

In some embodiments, temperature control pack 200 is a refillable container configured to be filled with liquid water that can be frozen to ice. In some embodiments, temperature control pack 200 includes one or more indicia 212, 214 indicating a level to which the temperature control pack 200 should be filled. In one exemplary embodiment, temperature control pack 200 may be filled with water to indicia 212 and frozen to provide a first temperature control mass, or temperature control pack 200 may be filled with water to indicia 214 and frozen to provide a second temperature control mass. The first temperature control mass associated with indicia 212 may be less than the second temperature control mass associated with indicia 214. Advantageously, this may allow a user to provide only the minimum weight in temperature control pack 200 to ship container 200 using a first shipping service, such as a 2 day shipping service, or more ice in temperature control pack for longer temperature control if a slower shipping speed is to be used, such as a 3, 4, or 5 day ground shipping service.

In some exemplary embodiments, it may be desirable to use the temperature control pack 200 to maintain a predetermined temperature range that is cooler than an external temperature. In these embodiments, the temperature control pack may include a cooling temperature control substance, such as ice.

In some exemplary embodiments, it may be desirable to use the temperature control pack 200 to maintain a predetermined temperature range that is warmer than an external temperature. In these embodiments, the temperature control pack may include a warming temperature control substance, such as warm water, hot water, or a heat generating chemical.

In some exemplary embodiments, it may be desirable to use the temperature control pack 200 to maintain a predetermined temperature range against fluctuations in the external temperature. In these embodiments, the temperature control pack may include a temperature control substance with a high phase change energy, such as ice or liquid water. In some embodiments, the thermal mass of temperature control pack 200 helps container 100 absorb thermal shocks, such as temporarily low and/or high environmental temperatures, to maintain the contents of the container 100 within the predetermined temperature range for a longer period of time.

In some embodiments, temperature control pack 200 is removed from tray 150 and/or cover 180 before heating or cooling the temperature control substance. In other embodiments, temperature control pack 200 is affixed to tray 150 and/or cover 180 when the temperature control substance is heated or cooled.

An exemplary method of using the container 100 is provided. The shipping insert 140 is positioned within internal cavity 128 of body 110. In some embodiments, the shipping insert 140 is permanently attached in the internal cavity 128. One or more items to be shipped, such as six bottles of wine, are each placed into a corresponding cavity 152A-152F of tray 150. The temperature control pack 200 is positioned in the central cavity 160. The cover 180 is then placed onto the tray 150, such that an upper portion of the item to be shipped is received within the corresponding upper cavity 182A-182F. The lid 130 is releasably secured to the body 110.

Figure 15:
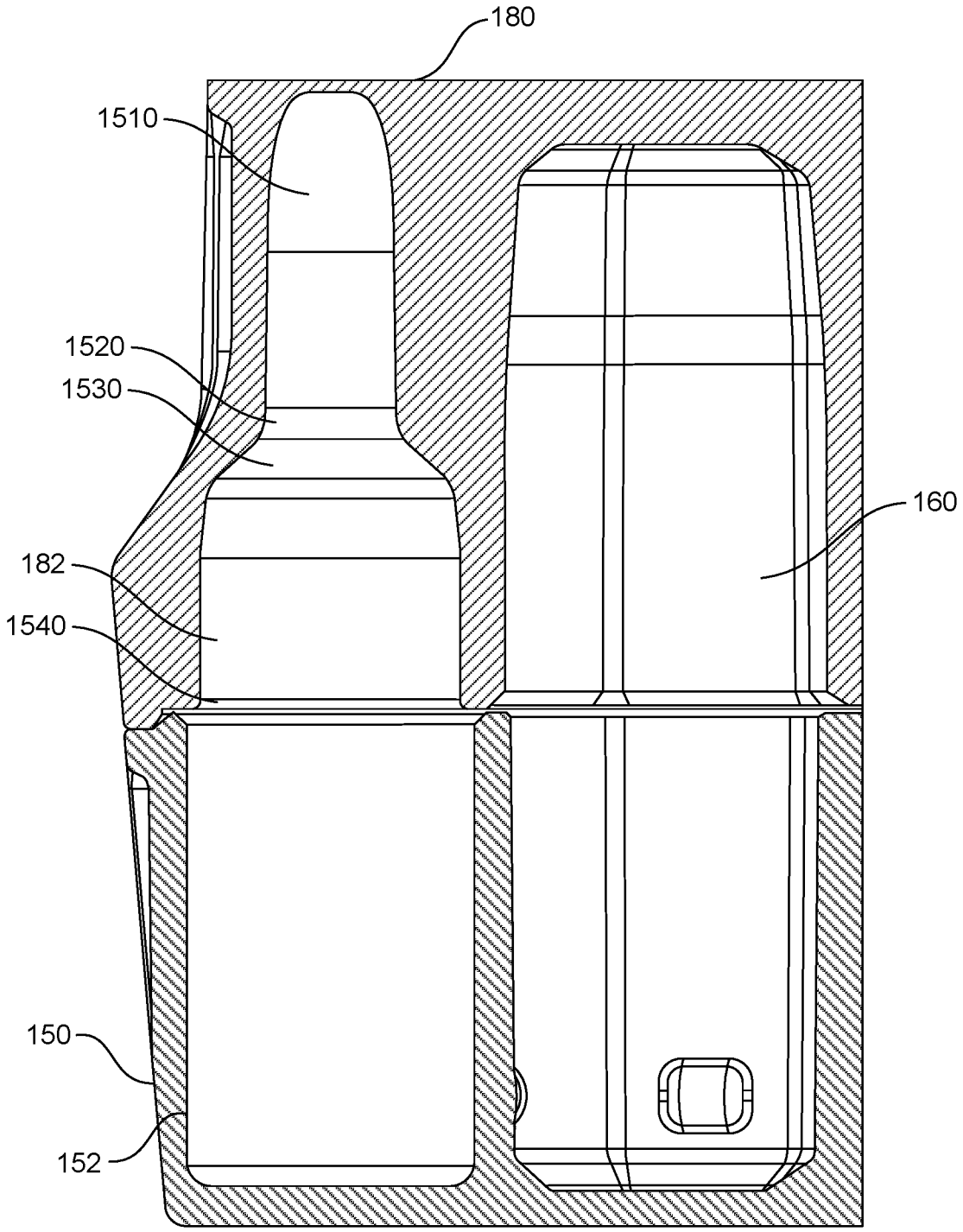
FIG. 15 illustrates a cross-section of a portion of a portable insulated shipping container including a storage cavity.

FIG. 15 illustrates a cross-section of a portion of portable insulated shipping container 100 including one of the plurality of storage cavities. The portion illustrated in FIG. 15 shows only a single bottle or storage cavity. The storage cavity comprises upper cavity 182 and lower cavity 152. Any of the plurality of bottle or storage cavities presented herein may include any of the features discussed with respect to FIGS. 15-21. The cross-section illustrated in FIG. 15 cuts through this single bottle or storage cavity and temperature control cavity 160. The bottle or storage cavity is formed from upper cavity 182 and lower cavity 152 when cover 180 is engaged with or placed upon tray 150.

There are many different types, shapes, and sizes of bottles. Even within the field of wine bottles, there are many shapes and sizes. Similar shapes or styles of bottles are often associated with certain varieties of wine. However, even for bottles of a specific capacity that are often associated with a certain variety of wine, there are often still minor variations in the bottle shapes. For this reason, it is challenging to design a universal, or semi-universal, shipping container that contacts a variety of bottles on many or all surfaces to completely eliminate movement of the bottles in the cavity. While eliminating bottle movement in a universal or semi-universal cavity will typically not be possible for all bottles, providing a design which reduces or minimizes the movement of various bottles still provides a significant benefit. If the shipping container is dropped or impacted, the distance the bottle travels within the cavity is proportional to the likelihood that the bottle is damaged and/or the cavity or container is breached by the bottle. Therefore, reducing the amount of potential movement significantly reduces the chance of damage.

In order to accommodate a variety of bottle shapes and sizes, the bottle cavities must be made large enough and/or with a shape that is accommodating of a variety of bottle shape variations. While each cavity may not be able to accommodate all of the bottle shapes and sizes under consideration, each cavity may be able to accommodate a subset of the bottle shapes and sizes under consideration. In order for this to be possible, the cavity will not be able to hold all of the types of bottles snugly and most or all of the bottles will have some degree of potential movement within the cavity. However, including stops or other cavity features that reduce the amount of movement or travel for various bottles improves the performance of the container in shipping and handling since less travel within the cavity reduces the likelihood that the bottle is damaged and/or the cavity, container, or insert is damaged by the bottle.

The bottle storage cavity illustrated in FIG. 15 includes upper cavity portion 182 which is formed in cover 180 and lower cavity 152 which is formed in tray 150. When cover 180 and tray 150 meet, are engaged, placed together, or temporarily attached to each other lower cavity 152 and upper cavity 182 form a single bottle cavity. The cavity is shaped to include a plurality of stop features at different locations. The stop features are positioned and sized to reduce movement of a variety of common bottle shapes and sizes. For example, the cavity includes a first stop feature 1510 in the bottle top area, a second stop feature 1520 near a bottom of the next area, a third stop feature 1530 near a shoulder area, and a fourth stop feature 1540 in a body area. More or fewer stop features are possible. Any of the stop features may be formed in either of cover 180, tray 150, and/or at an interface between cover 180 and tray 150.

In one example, portable insulated container 100 is used for transporting a plurality of bottles wherein the plurality of the bottles includes bottles having two or more bottle shapes and includes bottles having two more bottle sizes. Portable insulated container 100 includes an outer shell and a temperature control pack. The portable insulated container also includes a first insert portion that fits inside the outer shell and a second insert portion that also fits inside the outer shell and is configured to engage with the first insert portion to form a plurality of insulated cavities. In FIG. 15, the first insert portion and the second insert portion are illustrated as cover 180 and tray 150. The plurality of insulated cavities include temperature control pack cavity 160 for receiving the temperature control pack along with three or more separate bottle storage cavities, such as the cavity illustrated in FIG. 15 formed from upper cavity 182 and lower cavity 152. Each of the three or more bottle storage cavities is configured for receiving a respective one of the plurality of the bottles and each of the three or more bottle storage cavities is configured for receiving at least two of the bottle sizes and at least two of the bottle shapes. Each of the three or more bottle storage cavities may also be equidistant from temperature control pack cavity 160.

Figure 16:
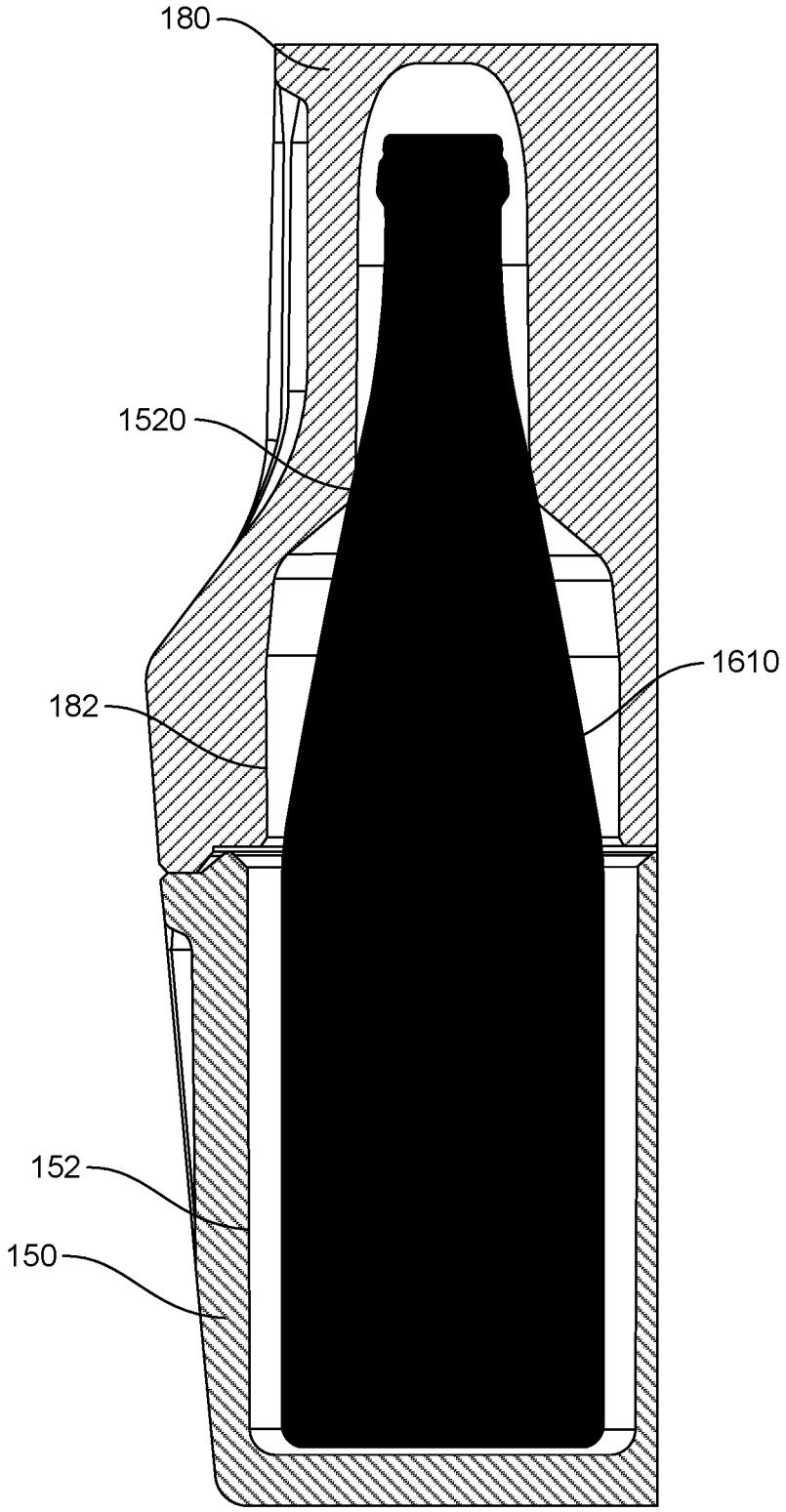
FIG. 16 illustrates a cross-section of a portion of a portable insulated shipping container including a storage cavity holding a first type of bottle.

FIG. 16 illustrates a cross-section of a portion of portable insulated shipping container 100 including the cavity of FIG. 15 holding a first bottle 1610. First bottle 1610 may be a Riesling style wine bottle. As illustrated, first bottle 1610 contacts or is in close proximity to second stop 1520 thereby reducing or eliminating the movement of first bottle 1610 in the cavity.

Figure 17:
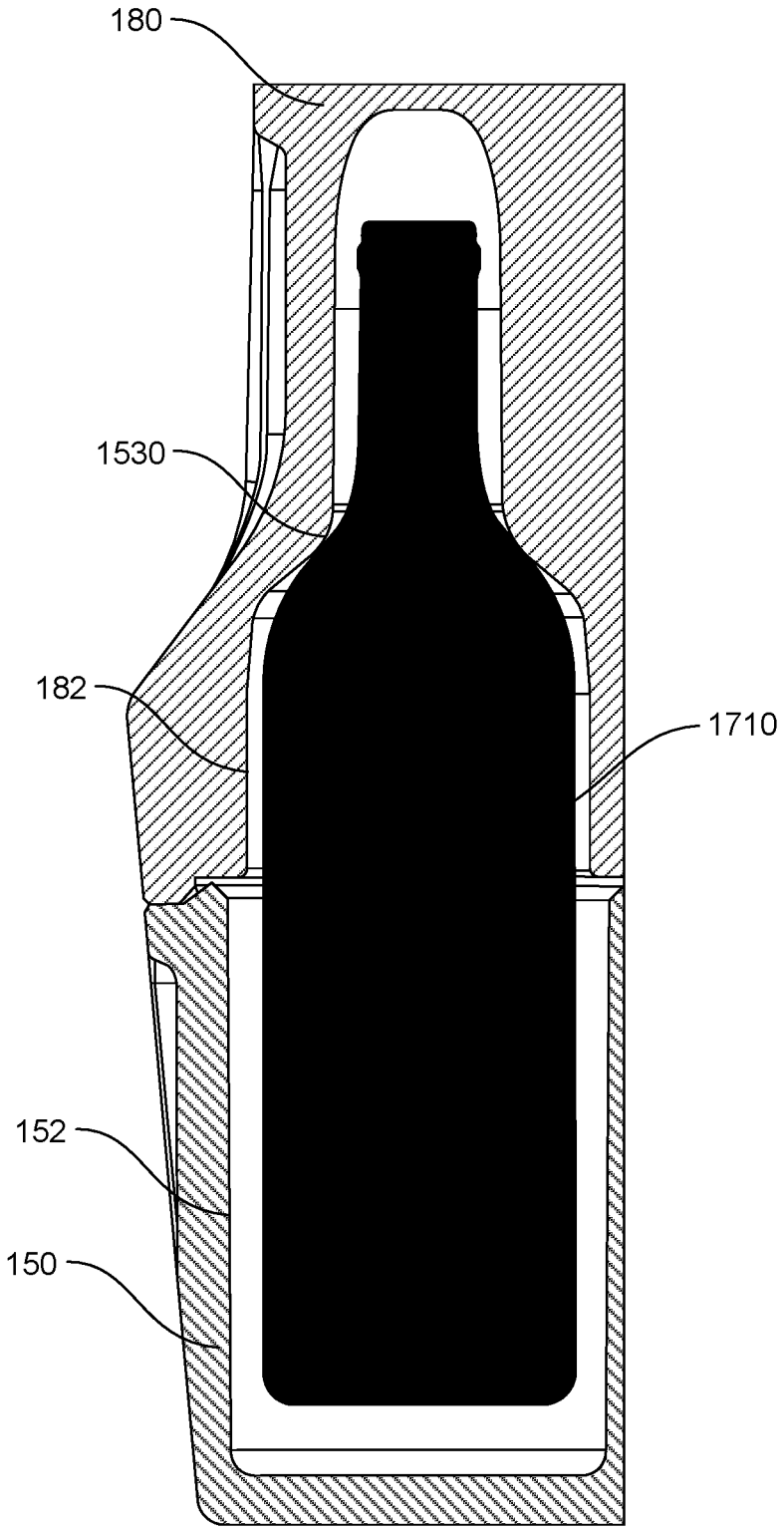
FIG. 17 illustrates a cross-section of a portion of a portable insulated shipping container including a storage cavity holding a second type of bottle.

FIG. 17 illustrates a cross-section of a portion of portable insulated shipping container 100 including the cavity of FIG. 15 holding a second bottle 1710. Second bottle 1710 may be a Bordeaux style wine bottle. As illustrated, second bottle 1710 contacts or is in close proximity to third stop 1530 thereby reducing or eliminating the movement of second bottle 1710 in the cavity.

Figure 18:
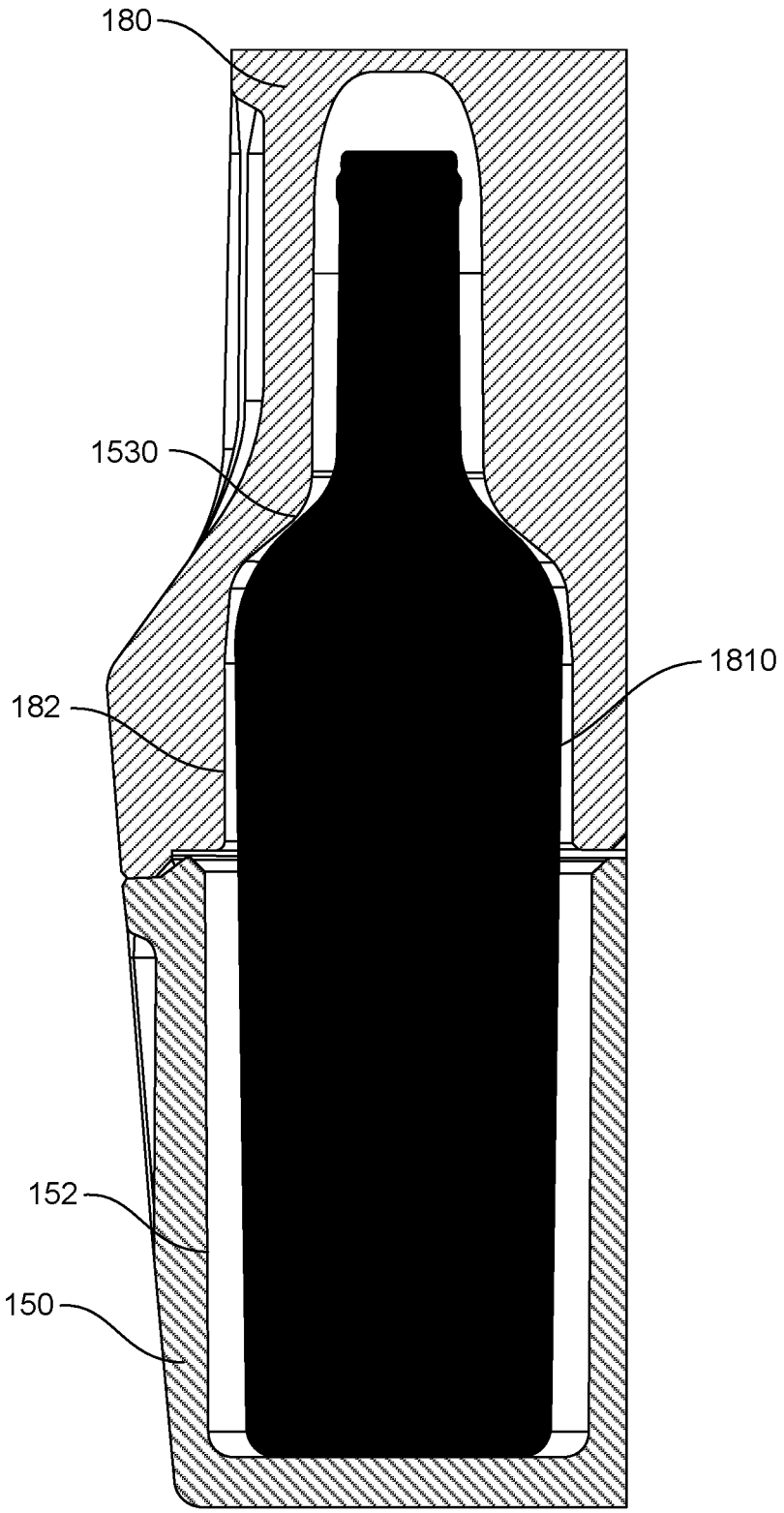
FIG. 18 illustrates a cross-section of a portion of a portable insulated shipping container including a storage cavity holding a third type of bottle.

FIG. 18 illustrates a cross-section of a portion of portable insulated shipping container 100 including the cavity of FIG. 15 holding a third bottle 1810. Third bottle 1810 may be another Bordeaux style wine bottle that is different in size or shape from second bottle 1710. As illustrated, third bottle 1810 contacts or is in close proximity to third stop 1530 thereby reducing or eliminating the movement of third bottle 1810 in the cavity. Third bottle 1810 would have more movement or travel if it relied only on one or more of the other stops in the cavity.

Figure 19:
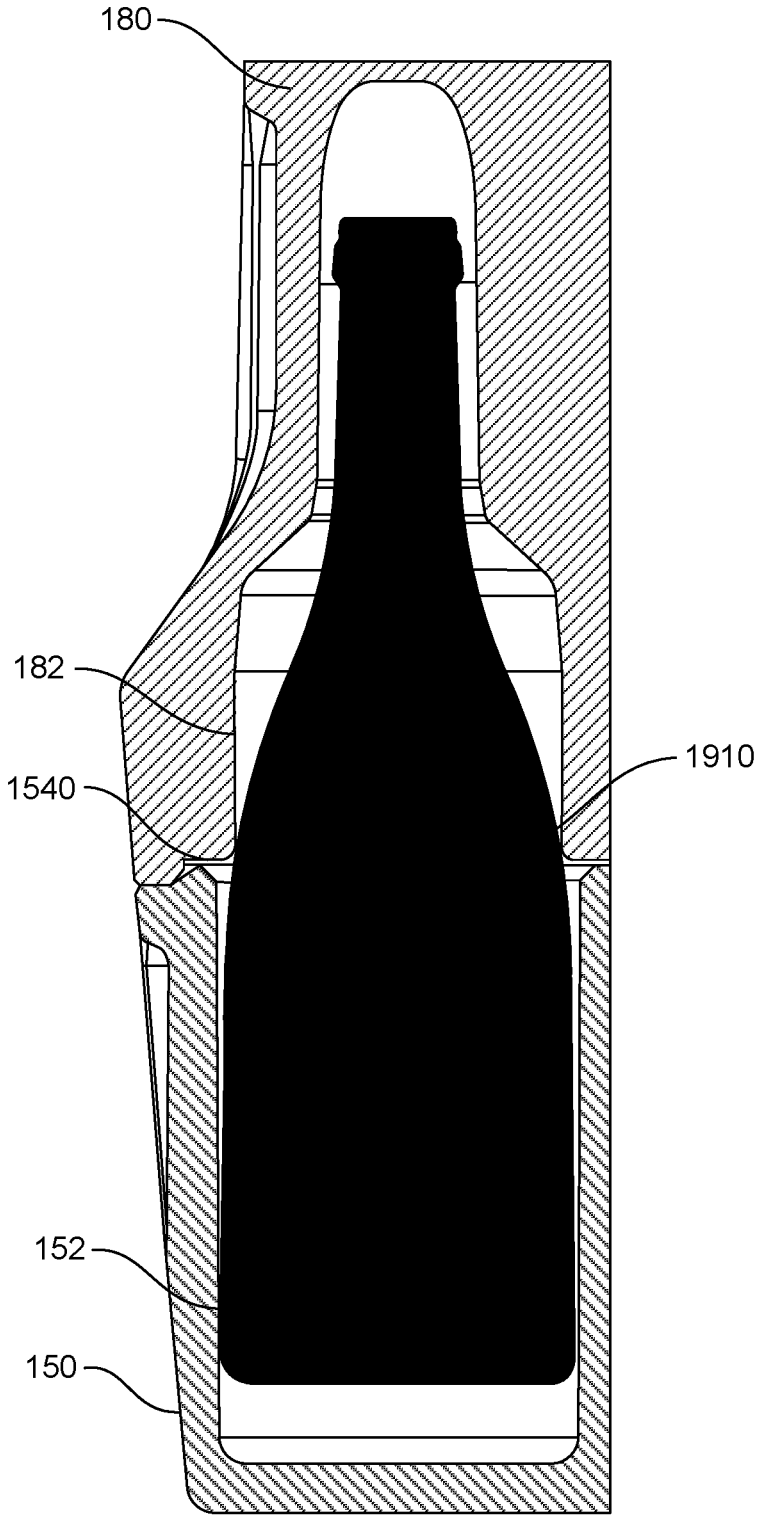
FIG. 19 illustrates a cross-section of a portion of a portable insulated shipping container including a storage cavity holding a fourth type of bottle.

FIG. 19 illustrates a cross-section of a portion of portable insulated shipping container 100 including the cavity of FIG. 15 holding a fourth bottle 1910. Fourth bottle 1910 may be a Burgundy style wine bottle. As illustrated, fourth bottle 1910 contacts or is in close proximity to fourth stop 1540 thereby reducing or eliminating the movement of fourth bottle 1910 in the cavity. Fourth bottle 1910 would have more movement or travel if it relied only on one or more of the other stops.

Figure 20:
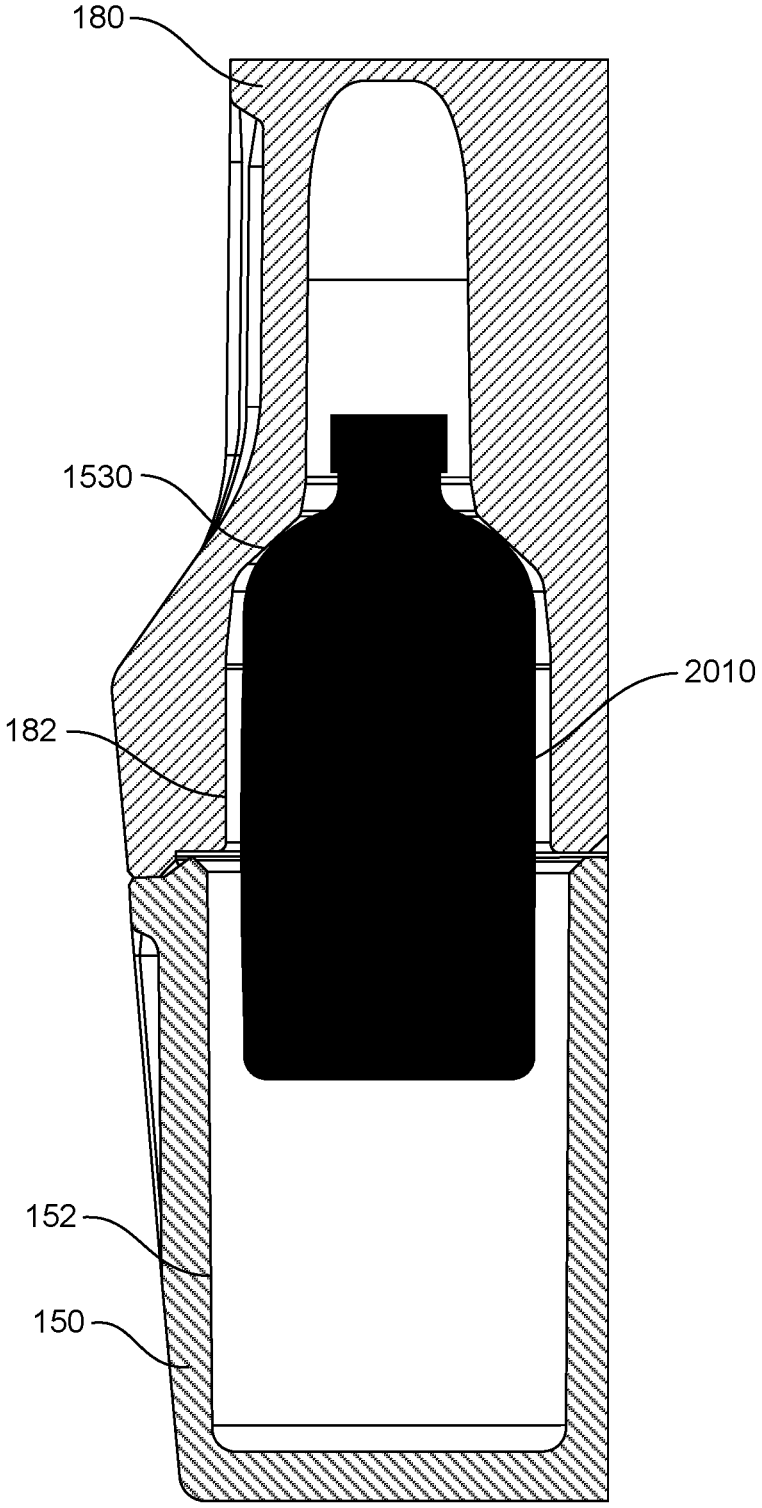
FIG. 20 illustrates a cross-section of a portion of a portable insulated shipping container including a storage cavity holding a fifth type of bottle.

FIG. 20 illustrates a cross-section of a portion of portable insulated shipping container 100 including the cavity of FIG. 15 holding a fifth bottle 2010. Fifth bottle 2010 may be a round 28 ounce style bottle. As illustrated, fifth bottle 2010 contacts or is in close proximity to third stop 1530 thereby reducing the movement of fifth bottle 2010 in the cavity.

Figure 21:
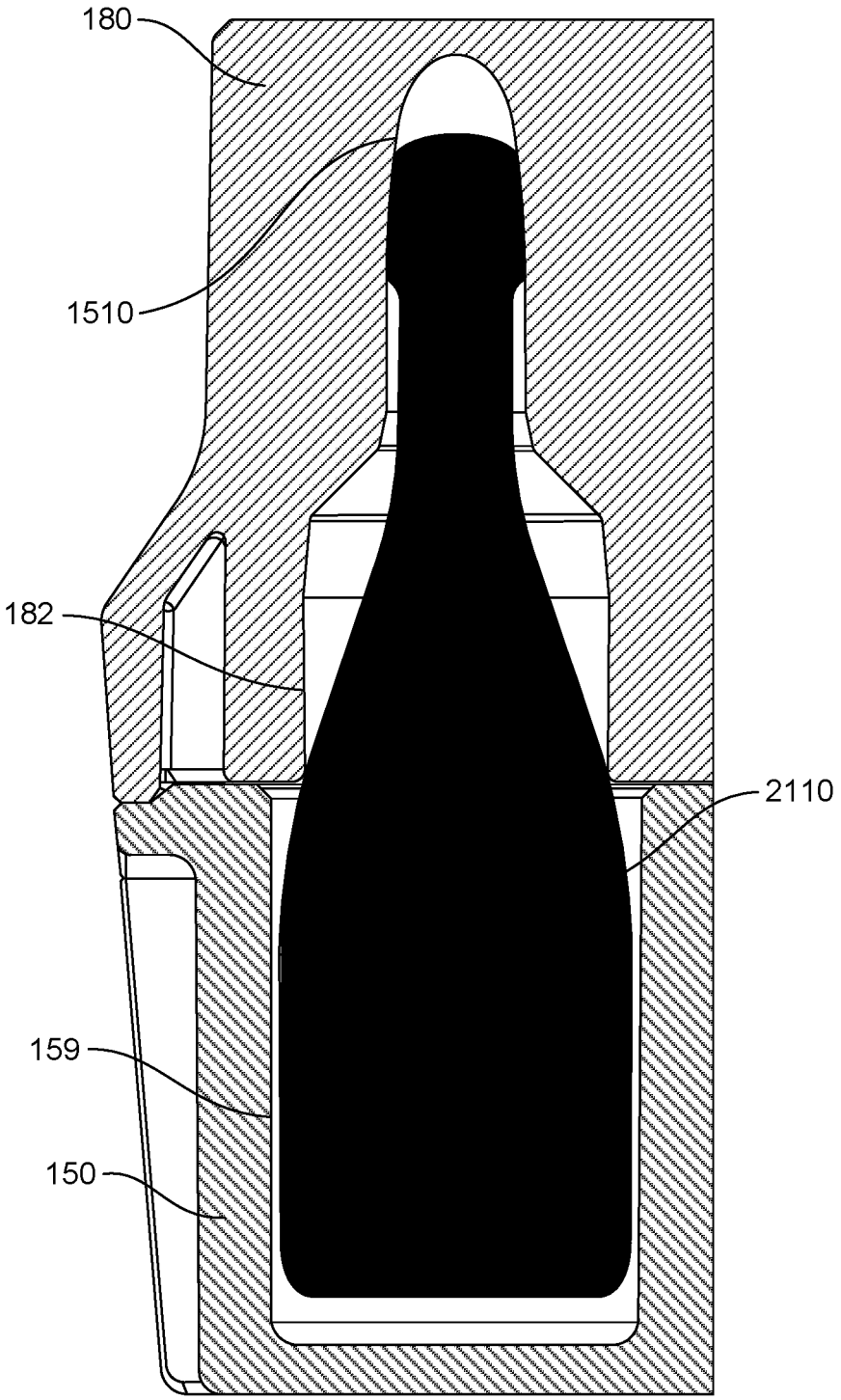
FIG. 21 illustrates a cross-section of a portion of a portable insulated shipping container including a larger storage cavity holding a sixth type of bottle.

FIG. 21 illustrates a cross-section of a portion of portable insulated shipping container 100 including a cavity holding a sixth bottle 2110. The cavity illustrated in FIG. 21 is different than the cavity illustrated in FIGS. 15-20. The cavity in FIG. 21 includes an upper cavity 182 that is the same as those in FIGS. 15-20. However, lower cavity 159 is different than lower cavity 152 of FIGS. 15-20. In particular, lower cavity 159 has a larger diameter than lower cavity 152. This larger cavity may be necessary to accommodate a bottle having a different shape or size, such as sixth bottle 2110, which may be a champagne or Brut style bottle. Often these types of bottles have thicker glass to accommodate the pressurized contents and may not fit in the openings which are designed for many other wine bottles.

There may be one or more of larger lower cavity 159 in tray 150 along with multiple lower cavities 152, and/or lower cavities of other sizes. If lower cavity 159 was used in every instance of a cavity in a particular shipping container, the bottles in those cavities would have less protection and/or more movement because of the large area. In this way, a single container can accommodate even more bottle shapes or sizes by having a variety of cavity sizes. As illustrated, sixth bottle 2110 contacts or is in close proximity to first stop 1530 thereby reducing the movement of sixth bottle 2110 in the cavity. Sixth bottle 2110 may also contact fourth stop 1540.

In some examples, cover 180 may also contain upper cavities of different sizes. For example, cover 180 may contain one or more upper cavities, which may be paired with any lower cavity, to accommodate a larger bottle, a bottle with a larger neck, a bottle with a larger decorative cork, a bottle with a champagne-type cork, and/or a bottle with a cork cage. Any variety of combinations of upper cavities and lower cavities are possible to form cavities of various sizes and having stops with various sizes and locations.

In other examples, one or more removable inserts may be used to temporarily reduce the size of any of the cavities disclosed herein. A removable insert may be placed in one or both of upper cavity 182 and lower cavity 152 to temporarily better fit a bottle having a smaller size and/or different shape and then later removed to return the cavity to its original size.

EXAMPLES

Figure 11:
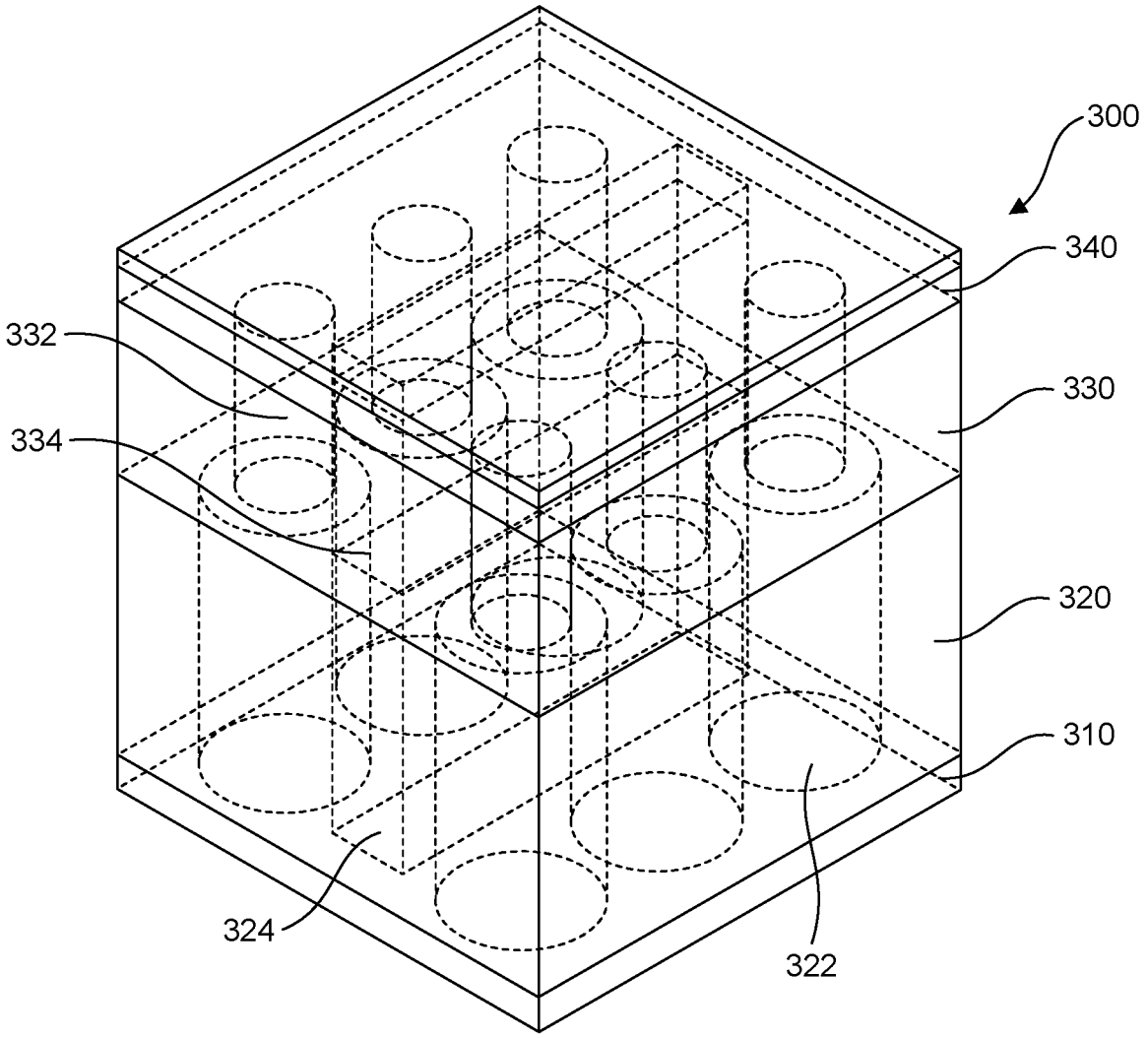
FIG. 11 illustrates an exemplary foam rig for comparing effect of bottle position on temperature.

The ability of a variety of geometries to maintain a predetermined temperature range was investigated. Referring to FIG. 11, an exemplary rig 300 is illustrated. Rig 300 was formed out of insulating foam. Rig 300 comprised a base 310, a lower layer 320 including a first plurality of openings 322 for receiving the bottom of a wine bottle 350 (not shown in FIG. 11) and a lower ice opening 324 for receiving an ice pack 360 (not shown in FIG. 11), an upper layer 330 including a second plurality of openings 332 for receiving the top of the wine bottles 350 and an upper ice opening 334 for receiving the top of the ice pack 360, and a top cover 340. The position of the plurality of openings 322, 332 and ice pack openings 324, 334 was varied among three examples as described below.

Figure 12A:
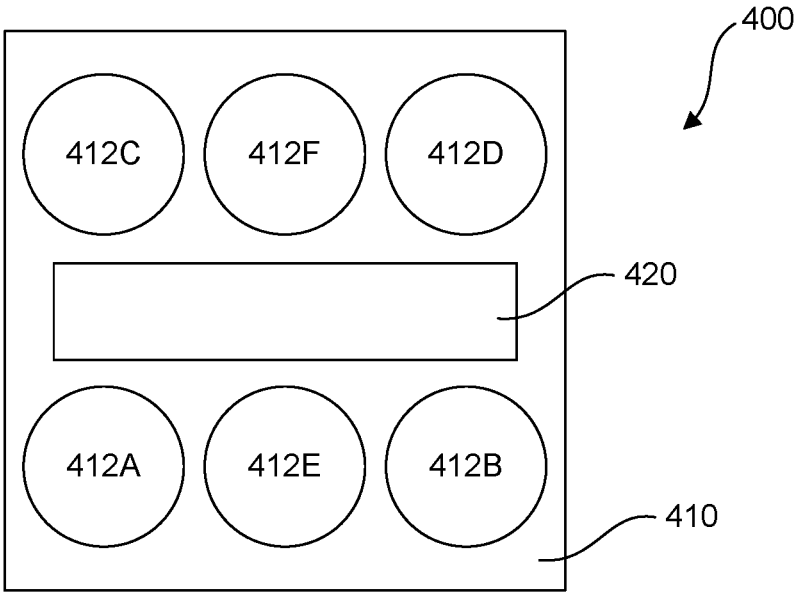
FIG. 12A illustrates a first exemplary configuration of six bottles and a temperature control pack.
Figure 12B:
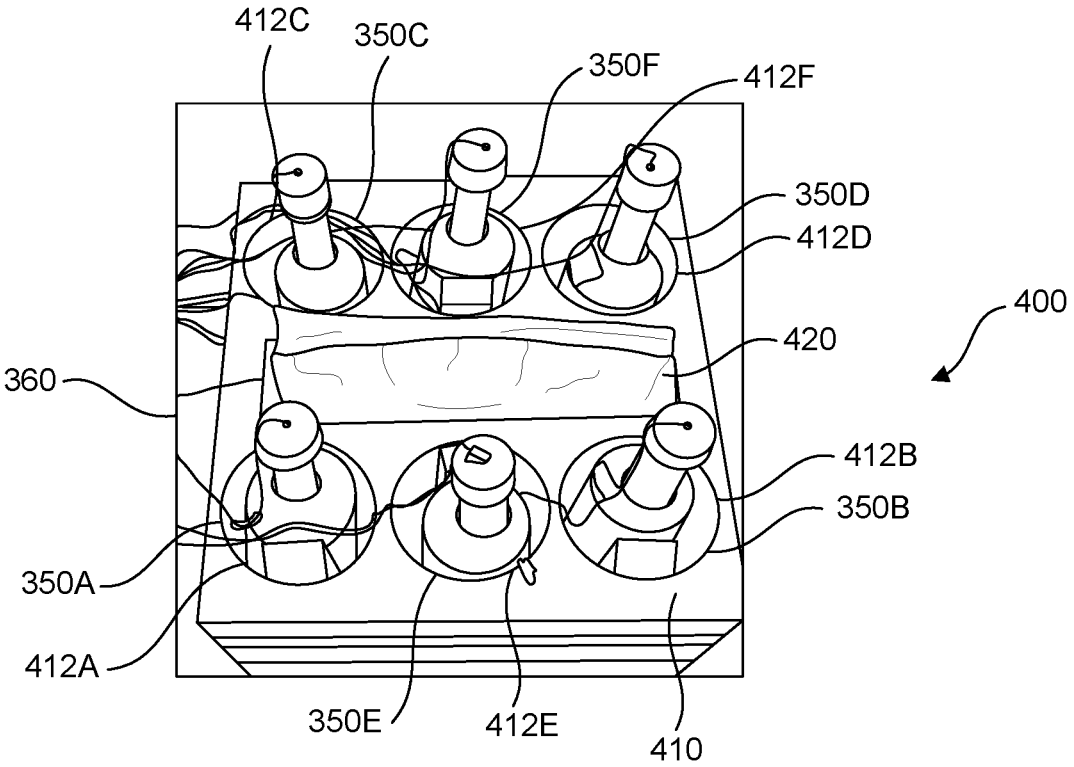
FIG. 12B is a test setup of the first exemplary configuration of FIG. 12A.

Example 1. Referring first to FIGS. 12A and 12B, a first example configuration 400 is illustrated in inline rig 410. Six openings 412A-412F are illustrated, each sized to receive a 4 inch diameter wine bottle 350A-350F. The openings 412 included corner openings 412A-412D and middle openings 412E and 412F. The thickness of foam between adjacent openings 412 was 0.5 inches. The thickness of foam between each opening 412A-412F and the ice opening 420 was 0.7 inches.

Figure 13A:
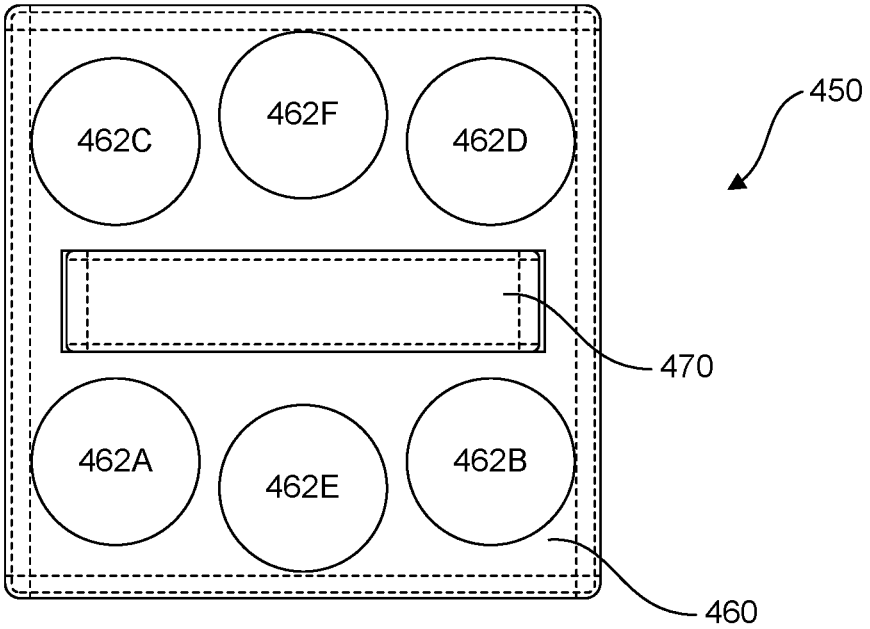
FIG. 13A illustrates a second exemplary configuration of six bottles and a temperature control pack.
Figure 13B:
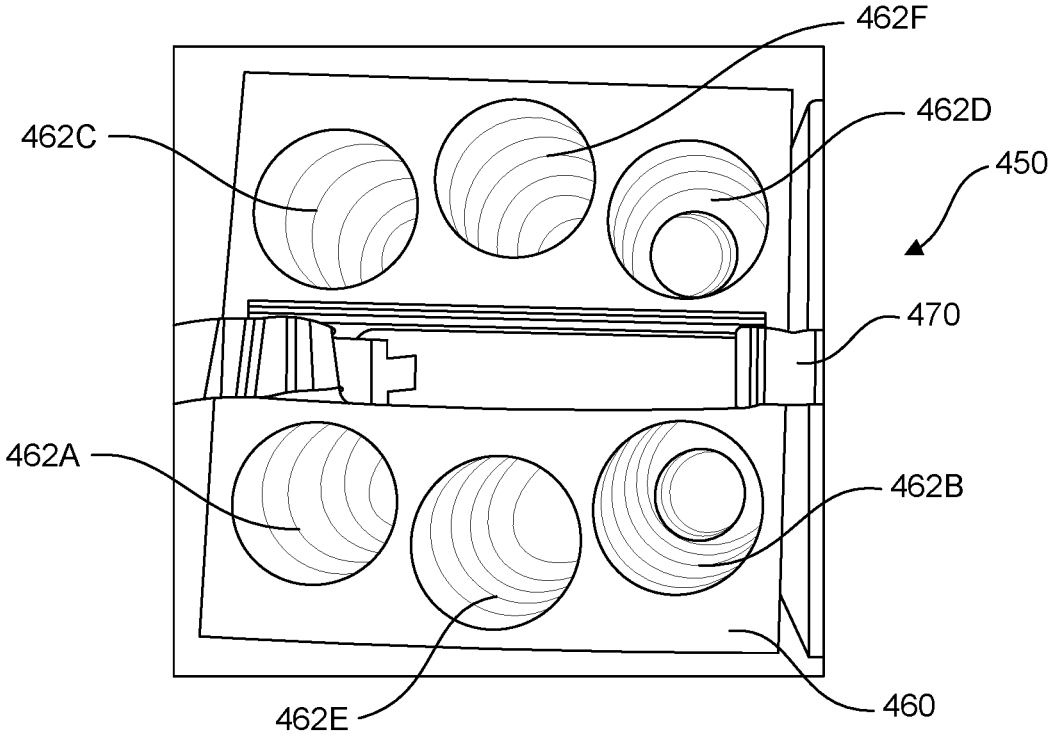
FIG. 13B illustrates of the second exemplary configuration of FIG. 13A.

Example 2. Referring next to FIGS. 13A and 13B, a second example configuration 450 is illustrated in offset rig 460. Six openings 462A-462F are illustrated, each sized to receive a 4 inch diameter wine bottle. The openings 462 included corner openings 462A-462D and middle openings 462E and 462F. The thickness of foam between adjacent openings 462 was 0.5 inches. The thickness of foam between each corner opening 462A-462D and the ice opening 470 was 0.625 inches. The thickness of foam between each middle opening 462E, 462F and the ice opening was 1.267 inches.

Figure 14A:
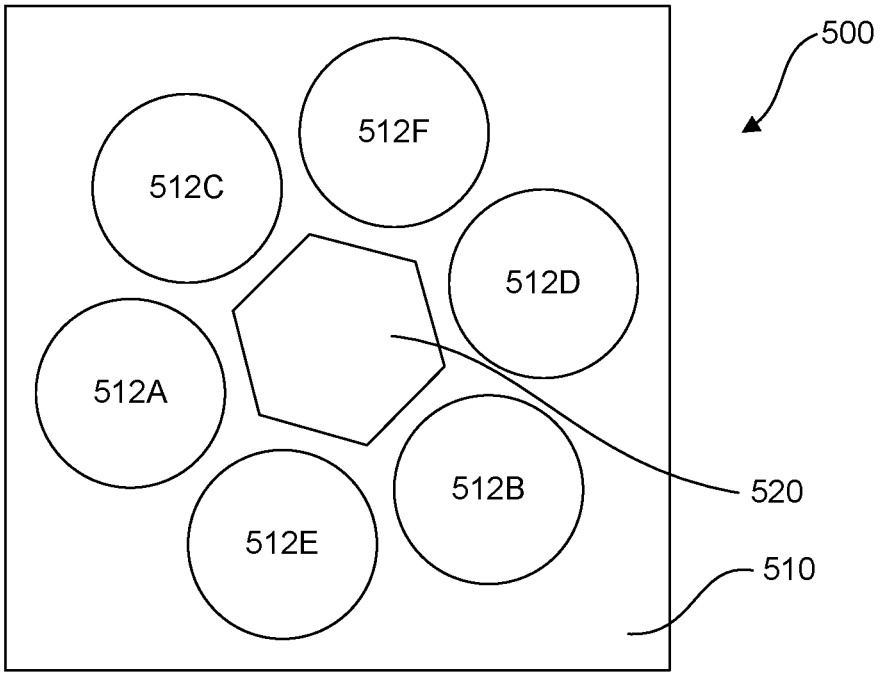
FIG. 14A illustrates a third exemplary configuration of six bottles and a temperature control pack.
Figure 14B:
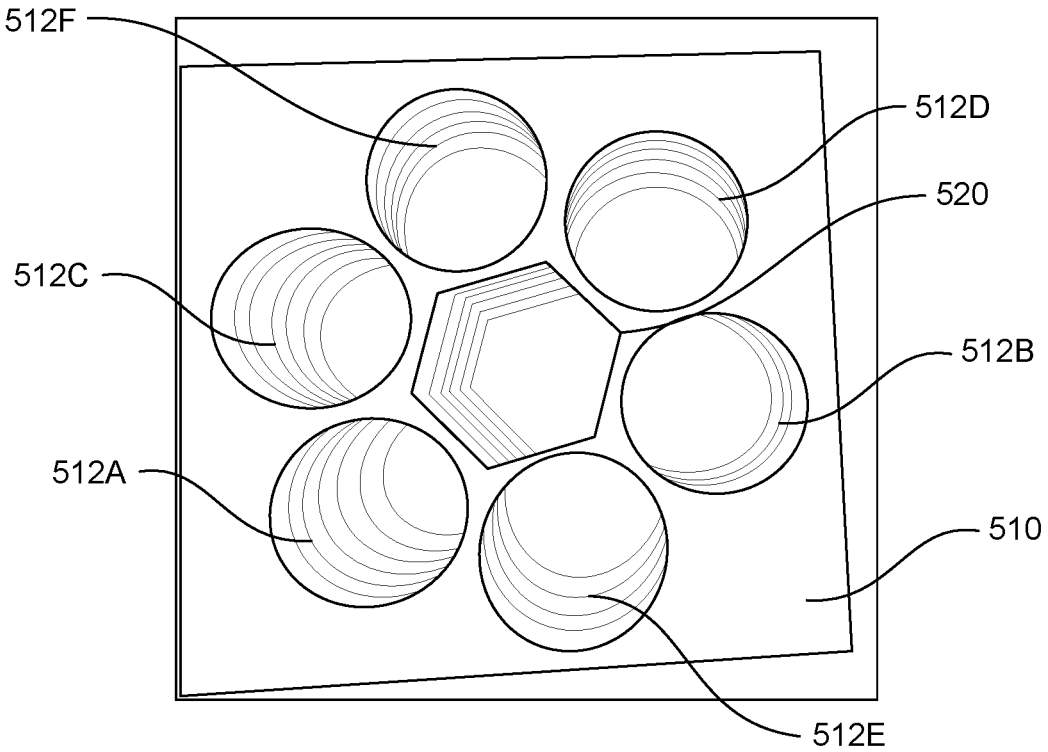
FIG. 14B illustrates the third exemplary configuration of FIG. 14A.

Example 3. Referring next to FIGS. 14A and 14B, a third example configuration 500 is illustrated in hexagonal rig 510. Six openings 512A-512F are illustrated, each sized to receive a 4 inch diameter wine bottle. The thickness of foam between adjacent openings 512 was 0.5 inches. The thickness of foam between each opening 512A-512F and the ice opening 520 was 0.5 inches.

For each example, six bottles of wine were prepared with a thermocouple disposed in the liquid. The starting temperature of all bottles was 55° F. One bottle was placed in each opening and a fully frozen ice pack was placed in the temperature pack opening. The layers of each rig were assembled as illustrated in FIG. 11, and each rig was placed in a temperature chamber at 100° F. The maximum temperature difference between bottles, the time for the fastest bottle to reach 70° F., and the time for the slowest bottle to reach 70° F. were recorded. The results are presented in Table 1 below.

TABLE 1

| Example | Configuration | Ice weight (pounds) | Max temp difference (° F.) | Fastest time to 70° F. (hr) | Slowest time to 70° F. (hr) |
|---|---|---|---|---|---|
| 1 | In-line | 7 | 7.5° F. | 8.1 hr | 17.0 hr |
| 2 | Off-set | 7 | 2.5° F. | 10.3 hr | 11.3 hr |
| 3 | Hexagonal | 6 | 1.5° F. | 14 hr | 17 hr |

As indicated in table 1, the greatest temperature difference between bottles was observed with Example 1, while the smallest temperature difference between bottles was observed with Example 3.

In addition, the hexagonal arrangement of Example 3 provided the longest time for all bottles to stay below 70° F., even though less ice was used in Example 3 (6 pounds) compared to Examples 1 and 2 (7 pounds).

Overall, the hexagonal arrangement of Example 3 in which the wine bottles were received in cavities equally spaced from each other and equally spaced around the central ice cavity provided the highest temperature consistency between the six tested bottles. The hexagonal arrangement also provided the longest time before any bottle reached the predetermined temperature of 70° F., even though Example 3 used 1/7 (~14%) less ice than Examples 1 or 2.

Any of the components disclosed herein may include or may be coated with an anti-microbial and/or anti-viral substance or ingredient.

Any of the techniques, improvements, features, functions, or processes described herein may be implemented in the form of a system or a kit. The system or kit may include any combination of the devices, components, elements, and/or modules disclosed herein.

The techniques, elements, components, methods, and steps described herein are meant to exemplify some types of possibilities. In no way should the aforementioned examples limit the scope of the invention, as they are only exemplary embodiments.

The phrases "in some embodiments," "according to some embodiments," "in the embodiments shown," "in other embodiments," "in some examples," "on other examples," "in some cases," "in some situations," "in one configuration, " "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure is presented for purposes of illustration and description. Other modifications and variations may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention except as limited by the prior art.

What is claimed:

1. An insulated shipping container system for transporting a plurality of bottles, the insulated shipping container system comprising:

a temperature control pack having a thermal mass; and a container including:

a first portion; and a second portion configured to mate with the first portion to form a plurality of internal cavities when the container is in a closed position, the plurality of internal cavities including:

a temperature control pack cavity configured for receiving the temperature control pack, wherein the temperature control pack cavity includes a plurality of side walls; and four or more separate bottle storage cavities distributed around the temperature control pack cavity, wherein each of the bottle storage cavities is adjacent to a separate one of the plurality of the side walls of the temperature control pack cavity and positioned equidistant from a center of the temperature control pack cavity, wherein each of the four or more bottle storage cavities is configured for receiving a bottle from among three or more different bottle types, wherein each of the three or more bottle types has a different shape and/or size than each of the other three or more bottle types, wherein each of the four or more bottle storage cavities includes at least three stop features configured for minimizing movement of a bottle in the respective bottle storage cavity, wherein each stop feature is associated with a different one of the three or more bottle types.

2. The insulated shipping container system of claim 1 wherein a first one of the three stop features is associated with a bottle top, a second one of the three stop features is associated with a bottom of a bottle neck, and a third one of the three stop features is associated with a bottle shoulder.

3. The insulated shipping container system of claim 2 wherein the at least three stop features are at least four stop features and a fourth one of the four stop features is associated with a bottle body.

4. The insulated shipping container system of claim 1 wherein a first subset of the four or more bottle storage cavities each has a first size and a second subset of the four or more bottle storage cavities each has a second size that is larger than the first size.

5. The insulated shipping container system of claim 4 wherein each of the second subset of the bottle storage cavities is configured to receive all of the bottle types and each of the first subset of the bottle storage cavities is configured to receive less than all of the bottle types.

6. The insulated shipping container system of claim 1 wherein the temperature control pack cavity has a cross-section having a polygon shape, wherein the polygon shape has a total number of sides equaling a total number of the four or more bottle storage cavities.

7. The insulated shipping container system of claim 6 wherein the polygon shape is a hexagon and the four or more bottle storage cavities are six bottle storage cavities.

8. The insulated shipping container system of claim 1 further comprising one or more vacuum insulated panels.

9. The insulated shipping container system of claim 1 further comprising at least one latch configured for removably attaching the first portion to the second portion, wherein the at least one latch includes a tamper evident feature.

10. An insulated container for storing or shipping a plurality of bottles, the insulated container comprising:

a body having a shell and an insert portion, wherein the insert portion is formed from an insulating material; and a lid having a shell and an insert portion, wherein the insert portion is formed from the insulating material and configured to meet the insert portion of the body to form a plurality of enclosed cavities when the insulated container is in a closed position, the plurality of internal cavities including:

a temperature control pack cavity configured for receiving a temperature control pack; and four or more separate bottle storage cavities distributed around the temperature control pack cavity, wherein each of the four or more bottle storage cavities is configured for receiving a bottle from among three or more different bottle types, wherein each of the four or more bottle storage cavities is separated from the temperature control pack cavity by a respective side wall of the temperature control pack cavity, wherein each of the four or more bottle storage cavities is equidistant from a center of the temperature control pack cavity, wherein each of the three or more bottle types has a different shape and/or size than each of the other three or more bottle types, wherein each of the four or more bottle storage cavities includes at least three bottle stop features on one or more internal surfaces of the respective bottle storage cavity, wherein each bottle stop feature is configured for reducing movement of a bottle when present in the respective bottle storage cavity, wherein each bottle stop feature is associated with a different one of the three or more bottle types.

11. The insulated container of claim 10 wherein each of the three stop bottle stop features is associated with a different one of: a bottle top, a bottle neck, a bottle shoulder, and a bottle body.

12. The insulated container of claim 10 wherein the insert portion of the body is removable from the shell of the body and replaceable with a different insert portion and the insert portion of the lid is removable from the shell of the lid and replaceable with a different insert portion.

13. The insulated container of claim 10 further comprising a temperature control pack which is removably insertable into the temperature control pack cavity.

14. The insulated container of claim 10 wherein the bottle types are wine bottle types.

15. The insulated container of claim 10 wherein the at least three bottle stop features are at least four bottle stop features.

16. An insulated container system for shipping a plurality of bottles, the insulated container system comprising:

a temperature control pack; and an insulated container including:

a body; and a lid that is selectively latchable to the body and adapted to engage the body to form a plurality of internal cavities in the insulated container when the insulated container is in a closed position, the plurality of internal cavities including:

a temperature control pack cavity adapted for receiving the temperature control pack, wherein the temperature control pack cavity includes a plurality of side walls; and a plurality of bottle storage cavities distributed around the temperature control pack cavity, wherein each of the plurality of bottle storage cavities is equidistant from a corresponding side wall of the temperature control pack cavity, wherein each of the plurality of bottle storage cavities is adapted for receiving a bottle from among four or more different bottle types, wherein each of the four or more bottle types has a different shape or size than each of the other four or more bottle types, wherein each of the plurality of bottle storage cavities includes at least four stop features adapted for reducing movement of a bottle in the respective bottle storage cavity during shipping, wherein each stop feature is associated with a different one of the four or more bottle types.

17. The insulated container system of claim 16 wherein the bottle types are wine bottle types and the plurality of bottle storage cavities are adapted to receive the wine bottle types.

18. The insulated container system of claim 16 wherein each of the body and the lid include a removable insert adapted to form respective portions of the plurality of internal cavities.

19. The insulated container system of claim 18 further comprising second removable inserts for each of the body and the lid, wherein the second removable inserts are adapted to form a second plurality of internal cavities in the container when the second removable inserts are installed instead of the removable inserts and the insulated container is in a closed position, the second plurality of internal cavities having different shapes or sizes than the plurality of internal cavities.

* * * * *